US005812903A

United States Patent [19]

Yamada et al.

[11] Patent Number: 5,812,903

[45] Date of Patent: Sep. 22, 1998

[54] IMAGE FORMING APPARATUS AND METHOD ENABLING TONER AMOUNT CONTROL WITHOUT ACTUAL MEASUREMENT OF TONER CHARACTERISTIC

[75] Inventors: Kunio Yamada; Atsushi Ogihara, both of Ashigarakami-gun, Japan

[73] Assignee: Fuji Xerox Co., Ltd., Tokyo, Japan

[21] Appl. No.: 780,155

[22] Filed: Dec. 26, 1996

[30] Foreign Application Priority Data

Dec. 28, 1995 [JP] Japan ..... 7-342910

[51] Int. Cl.[6] ..... G03G 15/00

[52] U.S. Cl. ..... 399/42; 399/49; 399/60

[58] Field of Search ..... 399/44, 49, 60, 399/42, 72

[56] References Cited

U.S. PATENT DOCUMENTS

| | | | |
|---|---|---|---|
| 4,878,082 | 10/1989 | Matsushita et al. . | |
| 5,029,314 | 7/1991 | Katsumi et al. | 399/44 |
| 5,216,463 | 6/1993 | Morita | 399/42 |
| 5,220,373 | 6/1993 | Kanaya | 399/42 |
| 5,237,370 | 8/1993 | Murai | 399/42 |
| 5,262,833 | 11/1993 | Fukushima et al. | 399/42 |
| 5,293,198 | 3/1994 | Sawayama et al. . | |
| 5,307,118 | 4/1994 | Morita | 399/42 |
| 5,327,196 | 7/1994 | Kato et al. | 399/58 |
| 5,477,308 | 12/1995 | Ohnishi et al. | 399/74 |
| 5,729,786 | 3/1998 | Yamada et al. | 399/42 |

FOREIGN PATENT DOCUMENTS

| | | |
|---|---|---|
| 0-520-144-A2 | 12/1992 | European Pat. Off. . |
| A-61-98370 | 5/1986 | Japan . |
| U-62-60742 | 4/1987 | Japan . |
| A-63-142379 | 6/1988 | Japan . |
| A-63-177174 | 7/1988 | Japan . |
| A-63-267979 | 11/1988 | Japan . |
| B2-63-60909 | 11/1988 | Japan . |
| A-63-296071 | 12/1988 | Japan . |
| A-64-35580 | 2/1989 | Japan . |
| A-1-108070 | 4/1989 | Japan . |
| A-1-147572 | 6/1989 | Japan . |
| A-1-161381 | 6/1989 | Japan . |
| A-1-214755 | 8/1989 | Japan . |
| A-1-314268 | 12/1989 | Japan . |
| A-2-8873 | 1/1990 | Japan . |
| A-2-110476 | 4/1990 | Japan . |
| 2-205873-A | 8/1990 | Japan . |
| A-2-256079 | 10/1990 | Japan . |
| A-3-75675 | 3/1991 | Japan . |
| B2-3-71067 | 11/1991 | Japan . |
| A-3-284776 | 12/1991 | Japan . |
| A-4-114183 | 4/1992 | Japan . |
| 4-336551-A | 11/1992 | Japan . |
| 5-035104-A | 2/1993 | Japan . |
| 5-289459-A | 11/1993 | Japan . |

*Primary Examiner*—Robert Beatty
*Attorney, Agent, or Firm*—Oliff & Berridge, PLC

[57] ABSTRACT

Operation variables such as laser power, grid voltage, and developing bias are corrected by using image-density controlling rules so as to control the image density. Control of toner supply is also effected by using the image-density controlling rules. A solid density reference pattern corresponding to actual values of the operation variables is measured, and a rule which fits the solid density is used to correct the operation variables. A solid density to be obtained with standard values of the operation variables is calculated by using the composed rule. A standard solid density for a standard toner concentration or a standard toner charge amount is outputted, and is compared with the calculated solid density. The toner supply is controlled in such a manner that an error between the two solid densities becomes zero, to thereby ensure that the toner concentration in a developing device or the toner charge amount reaches a standard value.

15 Claims, 26 Drawing Sheets

FIG. 7

| CONTROL CASE NO. | STATE VARIABLE | SET VALUE | | OUTPUT VALUES (SENSOR OUTPUT VALUE) | | |
|---|---|---|---|---|---|---|
| | DATE, HOUR, MINUTE, SECOND | LP SET VALUE | SCORO SET VALUE | SOLID | HIGHTLIGHT | |
| 1 | 951201120010 | 83 | 130 | 185 | 23 | CLUSTER ① |
| 2 | 951201120025 | 102 | 121 | 176 | 15 | |
| 3 | 951201120040 | 154 | 98 | 195 | 33 | |
| 1 | 951202090005 | 148 | 115 | 185 | 30 | CLUSTER ② |
| 2 | 951222090015 | 146 | 110 | 175 | 19 | |
| 3 | 951202020025 | 147 | 118 | 180 | 20 | |
| 4 | | | | | | |

FIG. 8

| CLUSTER NO. | STATE VARIABLE | CONTROL RULE COEFFICIENTS (GAINS) | | | | | |
|---|---|---|---|---|---|---|---|
| | DATE, HOUR, MINUTE, SECOND | a1 | a2 | a3 | b1 | b2 | b3 |
| 1 | 951201120010 | 12.19 | 26.74 | -4304 | 11.16 | 24.45 | -4082 |
| 2 | 951202090005 | 5.0 | 0 | -555 | 7.546 | -0.8189 | -992.6 |
| 3 | 951202093104 | | | | | | |

FIG. 23

| STATE VARIABLES | | SOLID DENSITY CORRESPONDING TO TARGET TONER CONCENTRATION |
|---|---|---|
| TEMPERATURE [°C] | HUMIDITY [%RH] | |
| 35 | 80 | 186 |
| 35 | 60 | 177 |
| 35 | 40 | 168 |
| 35 | 20 | 159 |
| 30 | 80 | 181 |
| 30 | 60 | 174 |
| 30 | 40 | 165 |
| 30 | 20 | |
| | | |

FIG. 27

| TEMPERATURE [°C] | STANDARD SET VALUES | |
|---|---|---|
| | STANDARD LP SET VALUE | STANDARD SCORO SET VALUE |
| 35 | 116 | 123 |
| 30 | 114 | 116 |
| 25 | 112 | 110 |
| 20 | 110 | 105 |
| 15 | 118 | 101 |
| 10 | | |

IMAGE FORMING APPARATUS AND METHOD ENABLING TONER AMOUNT CONTROL WITHOUT ACTUAL MEASUREMENT OF TONER CHARACTERISTIC

BACKGROUND OF THE INVENTION

1. Field of the Invention

The present invention relates to an apparatus and a method for forming an electrophotographic image which make it possible to control the supply of a toner to a developing device with high accuracy at low cost.

2. Description of the Related Art

Conventionally, in an image forming apparatus using an electrophotographic system based on two-component development, various techniques have been used to effect the supply of a toner with high accuracy. That is, the toner concentration (a mixing ratio between a toner and a carrier in a developing device; hereafter referred to as the TC) is determined by the supply of the toner, and the toner charge amount (i.e., electrification amount) is determined by the toner concentration, an environmental change, and the like. As a result, the toner concentration exerts a large influence on the quality of an output image, particularly the image density. To obtain best image quality, it is necessary to supply an optimum amount of toner.

As conventional methods of determining the amount of toner supply, it is possible to cite the- following three types as typical methods.

A first method is one in which, as disclosed in, for example, Japanese Unexamined Patent Publication Nos. 177174/1988, 267979/1988, 35580/1989, 147572/1989, 161381/1989, 214755/1989, and 256079/1990, and Japanese Examined Patent Publication No. 71067/1991, the TC of the interior of the developing device is directly measured by using a TC sensor, and the toner is supplied to the developing device such that the measured value of the TC becomes a prescribed value (hereafter, this method will be referred to the ATC method). Even if the TC is constant, the toner charge amount changes in correspondence with an environmental change and the like, so that, in order to make the image density constant, this method is frequently used jointly with the optimization of another electrophotographic parameter such as the potential contrast of an electrostatic latent image.

A second method is one in which, as disclosed in, for example, Japanese Unexamined U.M. Publication No. 60742/1987, Japanese Unexamined Patent Publication Nos. 142379/1988 and 296071/1988, and Japanese Examined Patent Publication No. 609090/1988, a reference image on a patch is prepared separately from an output image, the density of the reference image which has been developed is measured, and the toner is supplied such that its density assumes a prescribed value (hereafter, this method will be referred to as the ADC method). In this method, since, in many cases, an-electrostatic image of the reference patch is always developed under constant potential contrast, the fact that the density of the patch assumes a prescribed value means that the TC is variably controlled such that the toner charge amount is maintained at a constant level.

A third method is one in which, as disclosed in, for example, Japanese unexamined Patent Publication Nos. 108070/1989, 314268/1989, 8873/1990, 110476/1990, 75675/1991, and 284776/1991, the image density of an output image or the number of pixels that are written is counted, and the amount of toner consumption is estimated in a corresponding manner so as to supply the toner. That is, this is a method in which the amount of toner which is estimated to be consumed for forming an image is supplied (hereafter, this method will be referred to as a pixel counting method).

However, technical problems have remained in the respective above-described conventional toner supplying methods. In the ATC method, the TC sensor must be incorporated in the developing device, so that the cost of the TC sensor is incurred. Further, there has been a problem in that it is difficult to accurately transport a developing agent to the position where the TC sensor is installed and to allow the TC sensor to read a correct toner concentration.

In addition, there has been a problem peculiar to the TC sensor. Namely, in a sensor of the type in which the TC is measured by means of magnetism, hysteresis can occur in measured values, and in a sensor of the type in which the measurement is made by means of light (color or a quantity of reflected light), it has been impossible to measure the concentration of a black toner.

For example, although measures have been devised to correct the effect of temperature or humidity as disclosed in, for example, Japanese Unexamined Patent Publication Nos. 98370/1986 and 114183/1992, in order to realize the correction, it is necessary to additionally install a temperature sensor or a humidity sensor in the vicinity of the TC sensor. Hence, secondary and tertiary problems occur.

In the ADC method, in a case where variables of the external environment affecting the electrophotographic apparatus, such as temperature and humidity, have changed, a change in the image density is corrected by invariably controlling the TC. This method has a problem in that it is generally impossible to intentionally lower the TC. For example, in a case where the temperature or the humidity has risen sharply, the toner charge amount declines, so that the image density rises sharply. At this time, it is generally impossible to actively lower the TC in such a manner as to correct the same. Conventionally, the situation is such that after an image is outputted, and a toner is consumed correspondingly, it is inevitable to wait for the TC to decline naturally.

Conversely, in a case where the temperature or the humidity has declined, the toner charge amount rises, and the image density declines sharply. For this reason, it is necessary to supply the toner rapidly to increase the TC, thereby to increase the image density. However, even if the toner is supplied rapidly, there is a time lag until an actual effect appears. That is, in a case where a powder such as the toner is additionally supplied, a substantial agitation time is required until the developing agent (a mixture of the toner and the carrier) in the developing agent and the additional toner are mixed uniformly. Further, if the toner is added too rapidly, the TC rises appreciably only in the vicinity of a toner supplying port of the developing device until the additional toner is mixed uniformly, thereby producing unevenness in the density of the image. Therefore, there also has been a restriction in the toner supplying speed.

Thus, with the conventional ADC method, there has been a problem in that the response is low. Further, with this method, a reference patch image is generally prepared under a standard setting, i.e., in a state in which the charging potential, the exposing potential, or the like is maintained at a fixed level, in order to obtain an image output. Hence, an expensive sensor such as a potential sensor is required to effect the same accurately.

With the pixel counting method, there has been a problem in that even if the toner supply error may be very small in each print, the errors accumulate over a long term, leading to a large toner concentration error in the final run.

SUMMARY OF THE INVENTION

The present invention has been devised in view of the above-described circumstances, and its object is to provide an apparatus and a method for forming an image which, though simple, make it possible to control the amount of toner supply with high accuracy without requiring the TC sensor or the potential sensor and without accumulation of the toner concentration errors.

To attain the above-described object, according to the present invention, there is provided an electrophotographic image forming apparatus for forming an image by developing an electrostatic latent image with a toner while controlling a predetermined characteristic of the toner to a target value, said image forming apparatus comprising toner supplying means for supplying the toner to a developing device; means for forming a reference image; means for measuring a physical quantity of the formed reference image; storage means for storing a rule prescribing a relationship between the physical quantity of the reference image and a predetermined operation variable of a main body of the image forming apparatus; means for controlling the physical quantity of the reference image by correcting the operation variable by using the rule; calculating means for calculating, according to the rule, a first value of the physical quantity of the reference image to be obtained under a predetermined condition; output means for outputting a second value of the physical quantity of the reference image which is expected under the predetermined condition and a condition that the predetermined characteristic of the toner is set at the target value; means for generating a difference between the first and second values of the physical quantity of the reference image; and means for adjusting an amount of the toner to be supplied to the toner supplying means in accordance with the generated difference.

With this configuration, a comparison is made between, on the one hand, a physical quantity concerning the reference image which is estimated when the characteristic of the toner assumes a target value and, on the other hand, the physical quantity calculated by a rule used for controlling the physical quantity. Consequently, the target value and the value of the present characteristic of the toner are indirectly compared. The toner supply is controlled in correspondence with the result of this comparison, thereby providing control such that the characteristic of the toner is maintained at the target value.

In this configuration, a toner/carrier mixing ratio or an toner charge amount may be used as the characteristic of the toner.

The calculating means may calculate the first value of the physical quantity of the reference image by using, as a reference, the value measured by the measuring means.

To attain the above-described object, according to another aspect of the invention, there is provided an electrophotographic image forming apparatus for forming an image by developing an electrostatic latent image with a toner while controlling a toner/carrier mixing ratio to a target value, said image forming apparatus comprising toner supplying means for supplying the toner to a developing device; means for forming a reference image; means for measuring an optical density of the formed reference image; storage means for storing a rule prescribing a relationship between the optical density of the reference image and a predetermined operation variable of a main body of the image forming apparatus; means for controlling the optical density of the reference image by correcting the operation variable by using the rule; calculating means for calculating, according to the rule, a first value of the optical density of the reference image to be obtained when the operation variable is set at a predetermined standard value; output means for outputting a second value of the optical density of the reference image which is expected under conditions that the operation variable is set at the predetermined standard value and the toner/carrier mixing ratio is set at the target value; means for generating a difference between the first and second values of the optical density of the reference image; and means for adjusting an amount of the toner to be supplied to the toner supplying means in accordance with the generated difference.

With this configuration, a comparison is made between, on the one hand, an optical density of the reference image which is estimated when the toner/carrier mixing ratio assumes a target value and, on the other hand, the optical density calculated by a rule used for controlling the optical density. Consequently, the target value and the value of the present toner/carrier mixing ratio are indirectly compared. The toner supply is controlled in correspondence with the result of this comparison, thereby providing control such that the toner/carrier mixing ratio is maintained at the target value.

In this configuration, the image forming apparatus may further comprise environmental-variable measuring means for measuring an environmental variable of the main body of the image forming apparatus, wherein the output means estimates and outputs the second value of the optical density of the reference image in accordance with a measured value of the environmental-variable measuring means.

To attain the above-described object, according to still another aspect of the invention, there is provided an electrophotographic image forming apparatus for forming an image by developing an electrostatic latent image with a toner while controlling a toner charge amount at a target value, said image forming apparatus comprising toner supplying means for supplying the toner to a developing device; means for forming a reference image; means for measuring an optical density of the formed reference image; storage means for storing a rule prescribing a relationship between the optical density of the reference image and a predetermined operation variable of a main body of the image forming apparatus; means for controlling the optical density of the reference image by correcting the operation variable by using the rule; calculating means for calculating, according to the rule, a first value of the optical density of the reference image to be obtained when the operation variable is set at a value for making a potential of a latent image of the reference image a predetermined standard potential; output means for outputting a second value of the optical density of the reference image which is expected when the potential of the latent image of the reference image is set at the standard potential and the toner charge amount is set at the target value; means for generating a difference between the first and second values of the optical density of the reference image; and means for adjusting the toner charge to be supplied to the toner supplying means in accordance with the generated difference.

With this configuration, a comparison is made between, on the one hand, an optical density of the reference image which is estimated when the toner charge amount assumes a target value and, on the other hand, the optical density calculated by a rule used for controlling the optical density. Consequently, the target value and the value of the present toner charge amount are indirectly compared. The toner supply is controlled in correspondence with the result of this comparison, thereby providing control such that the toner charge amount is maintained at the target value.

In this configuration, the image forming apparatus may further comprise environmental-variable measuring means for measuring an environmental variable of the main body of the image forming apparatus, wherein the output means estimates and outputs the second value of the optical density of the reference image in accordance with a measured value of the environmental-variable measuring means.

In the above configurations, the image forming apparatus may further comprise rule forming means for forming the rule based on data of the physical quantity and the operation variable which are obtained when the reference image is formed a plurality of times.

The rule storage means may store the rule for each of different states.

The image forming apparatus may further comprise rule composing means for composing a rule suitable for values of the optical density and the operation variable obtained when a current reference image is formed from the rules stored in the rule storage means, wherein the calculating means calculates the first value of the optical density by using the composed rule.

Whether the states are different from each other may be determined based on at least one of a temperature, a humidity, and a cumulative number of formed images.

To attain the above-described object, according to a further aspect of the invention, there is provided an electrophotographic image forming method for forming an image by developing an electrostatic latent image with a toner while controlling a predetermined characteristic of the toner to a target value, comprising the steps of supplying the toner to a developing device; forming a reference image; measuring a physical quantity of the formed reference image; storing a rule prescribing a relationship between the physical quantity of the reference image and a predetermined operation variable of a main body of an image forming apparatus; controlling the physical quantity of the reference image by correcting the operation variable by using the rule; calculating, according to the rule, a first value of the physical quantity of the reference image to be obtained under a predetermined condition; outputting a second value of the physical quantity of the reference image which is expected under the predetermined condition and a condition that the predetermined characteristic of the toner is set at the target value; generating a difference between the first and second values of the physical quantity; and adjusting an amount of the toner to be supplied to the toner supplying means in accordance with the difference.

With this method, a comparison is made between, on the one hand, a physical quantity concerning the reference image which is estimated when the characteristic of the toner assumes a target value and, on the other hand, the physical quantity calculated by a rule used for controlling the physical quantity. Consequently, the target value and the value of the present characteristic of the toner are indirectly compared. The toner supply is controlled in correspondence with the result of this comparison, thereby providing control such that the characteristic of the toner is maintained at the target value.

BRIEF DESCRIPTION OF THE DRAWINGS

FIG. 7 is a diagram explaining case data stored in a control case memory 25 shown in FIG. 6;

FIG. 8 is a diagram explaining case data stored in a control rule memory 29 shown in FIG. 6;

FIG. 23 is a diagram explaining a data configuration of a LUT in a standard solid density retriever 54 in the first embodiment shown in FIG. 1;

FIG. 27 is a diagram explaining a data configuration of a LUT in a standard operation variable retriever 62 in the second embodiment shown in FIG. 26;

DESCRIPTION OF THE PREFERRED EMBODIMENTS

Figure 1:
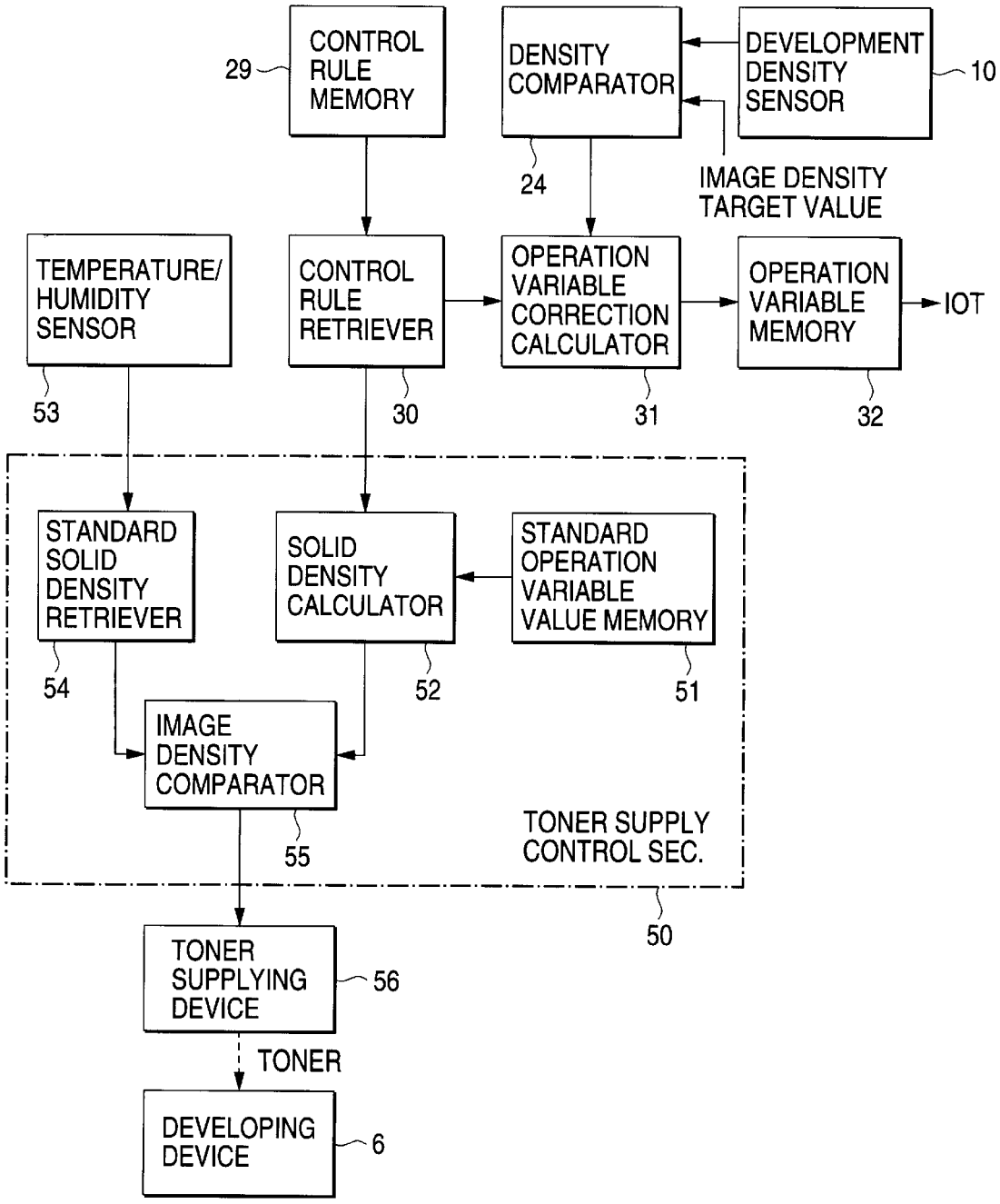
FIG. 1 is a block diagram which mainly illustrates a configuration of a toner supply control section 50 in accordance with a first embodiment of the present invention.

Referring now to the drawings, a description will be given of two embodiments of the present invention. In these embodiments, the present invention is applied to an image forming apparatus of an electrophotographic system which controls the image density by using a laser output and a grid potential of a scorotron charger as operation variables. That is, control is effected such that the image density becomes constant by using control rules which prescribe relationships between, on the one hand, the laser output and the grid potential of the scorotron charger and, on the other hand, the image density (solid density, highlight density, etc.). The control rules may be prepared from case data obtained by driving the image forming apparatus, or those control rules that have been prepared in advance may be used. Then, by using these rules, control is provided in such a manner that the characteristics concerning the toner, such as the TC and the toner charge amount (i.e., electrification amount), become constant. First, a description will be given of a specific configuration of an image forming apparatus used in the first and second embodiments as well as a configuration of a control system for controlling the image density.

[1] Configuration of Image Forming Apparatus

[1.1] Configuration of IOT

Figure 2:
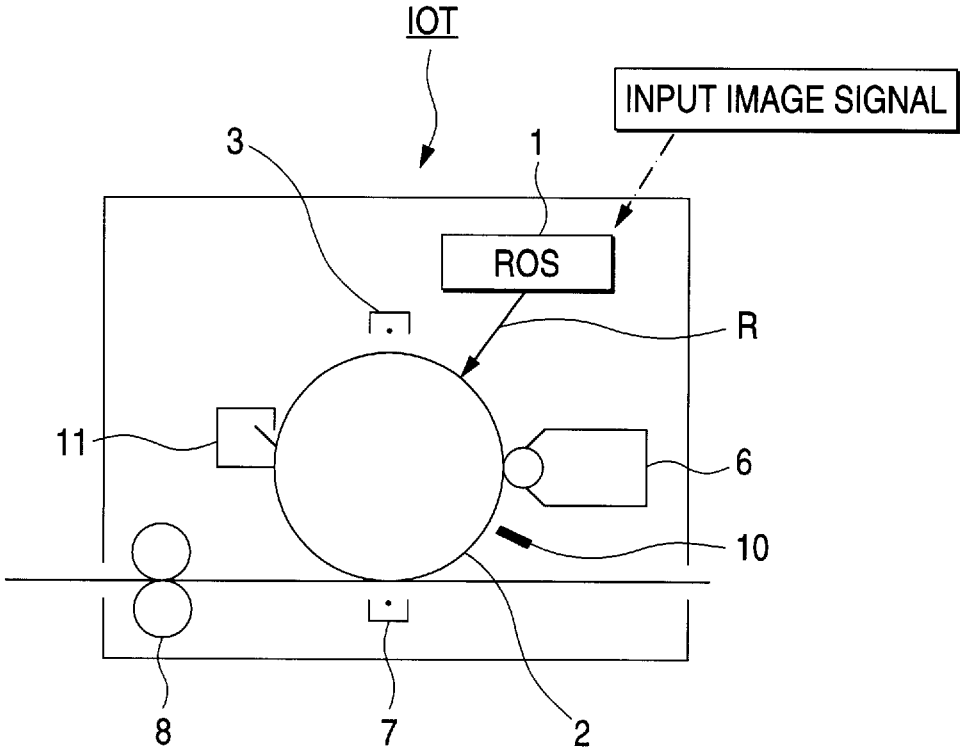
FIG. 2 is a block diagram illustrating a configuration of an image output section IOT of an image forming apparatus of an electrophotographic system used in first and second embodiments of the present invention.

An outline of an image output section IOT (image output terminal) of the image forming apparatus is shown in FIG. 2. Incidentally, an image reading section and an image processing section are omitted in FIG. 2. That is, only the image output section IOT based on the electrophotographic system is shown.

To describe the procedure of forming an image with reference to FIG. 2, the image processing section (not shown) effects appropriate processing with respect to an original image signal obtained by reading an original by the image reading section (not shown) or by being prepared by an external computer (not shown). The input image signal thus obtained is inputted to a laser output unit 1 to modulate a laser beam R. The laser beam R thus modulated by the input image signal is raster-radiated to a photoreceptor 2.

Meanwhile, the photoreceptor 2 is uniformly charged by a scorotron charger 3, and when the laser beam R is radiated thereto, an electrostatic latent image corresponding to the input image signal is formed on its surface. Next, the electrostatic latent image is subjected to toner development by a developing device 6, and the development toner is transferred onto paper (not shown) by a transfer device 7, and is fused by a fusing device 8. Subsequently, the photoreceptor 2 is cleaned by a cleaner 11, thereby completing one image-forming operation. In addition, reference numeral 10 denotes a development density sensor for detecting the densities of development patches (which will be described later) which are formed outside an image area.

[1.2] Development-Patch Preparing Mechanism and Its Monitoring Mechanism

Figure 3:
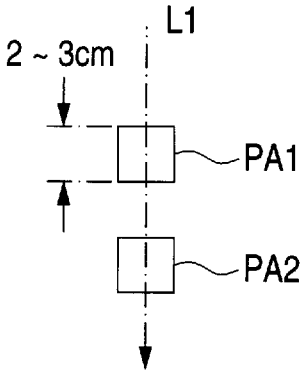
FIG. 3 is a diagram explaining the generation of density-detecting patches used in the first and second embodiments of the present invention.
Figure 4:
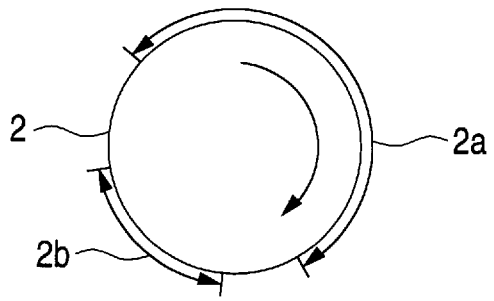
FIG. 4 is a diagram illustrating timings at which the patches shown in FIG. 3 and images are formed on the basis of input signals.

Next, a description will be given of development patches and a mechanism for monitoring them. The development patches are for monitoring an output image density, and a solid (halftone dot coverage of 100%) density patch PA1 and a highlight (halftone dot coverage of 20%) density patch PA2 are adopted, as shown in FIG. 3. Each of the solid density patch PA1 and the highlight density patch PA2 is set to the size of a 2 to 3 cm square as shown in FIG. 3, and is formed outside the image area of the photoreceptor 2. Namely, as shown in FIG. 4, after a latent image is formed in an image area 2*a*, the solid density patch PA1 and the highlight density patch PA2 are consecutively formed in a blank area 2*b*.

The development density sensor 10 is comprised of an LED-emitting portion for emitting light onto the surface of the photoreceptor 2 and a photosensor for receiving regularly reflected light or diffused light from the surface of the photoreceptor 2. The line L1 shown in FIG. 3 is a detection line of the development density sensor 10. Accordingly, the solid density patch PA1 and the highlight density patch PA2 are formed on the detection line L1, and consecutively pass a vicinity of the development density sensor 10.

Figure 5:
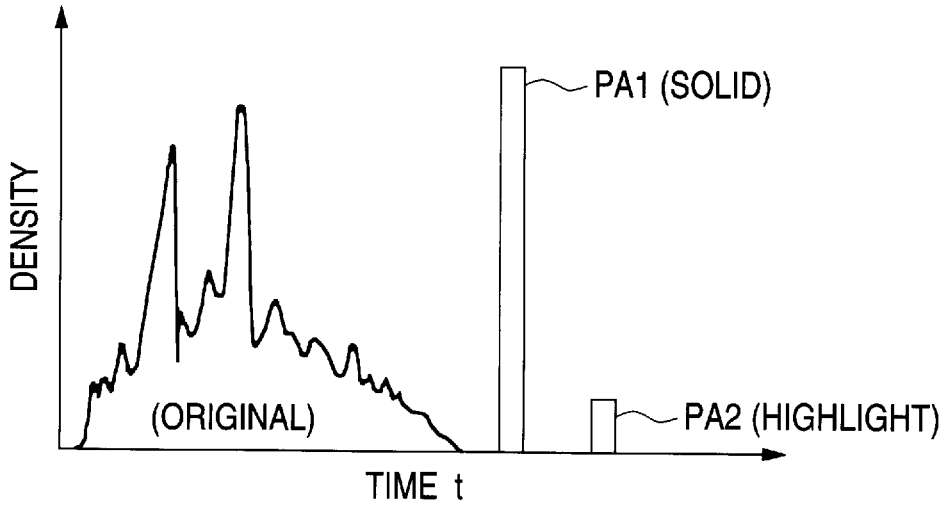
FIG. 5 is a diagram explaining the density of the images formed in FIG. 4.

Here, FIG. 5 is a diagram illustrating an example of an output signal from the development density sensor 10. As shown, a density detection signal corresponding to the image of the original is first obtained, and density signal detection signals representing the solid density patch PA1 and the highlight density patch PA2 are then obtained. Since the solid density patch PA1 and the highlight density patch PA2 are formed outside the image area, they are not transferred onto the paper, and are erased when they pass a portion of the cleaner 11.

Incidentally, the reason that the densities of the development patches are detected in this embodiment is because the densities of the development patches have high correlations with the density of the fused image obtained by the user (final image density), and removal with the cleaner 11 is possible. In addition, the development patches may be formed within the image area if they are formed at a timing other than the time of image formation. Further, as development patches, those with other halftone dot coverages may be used.

[2] Control of Image Density

[2.1] Configuration of Image Density Control Section

Figure 6:
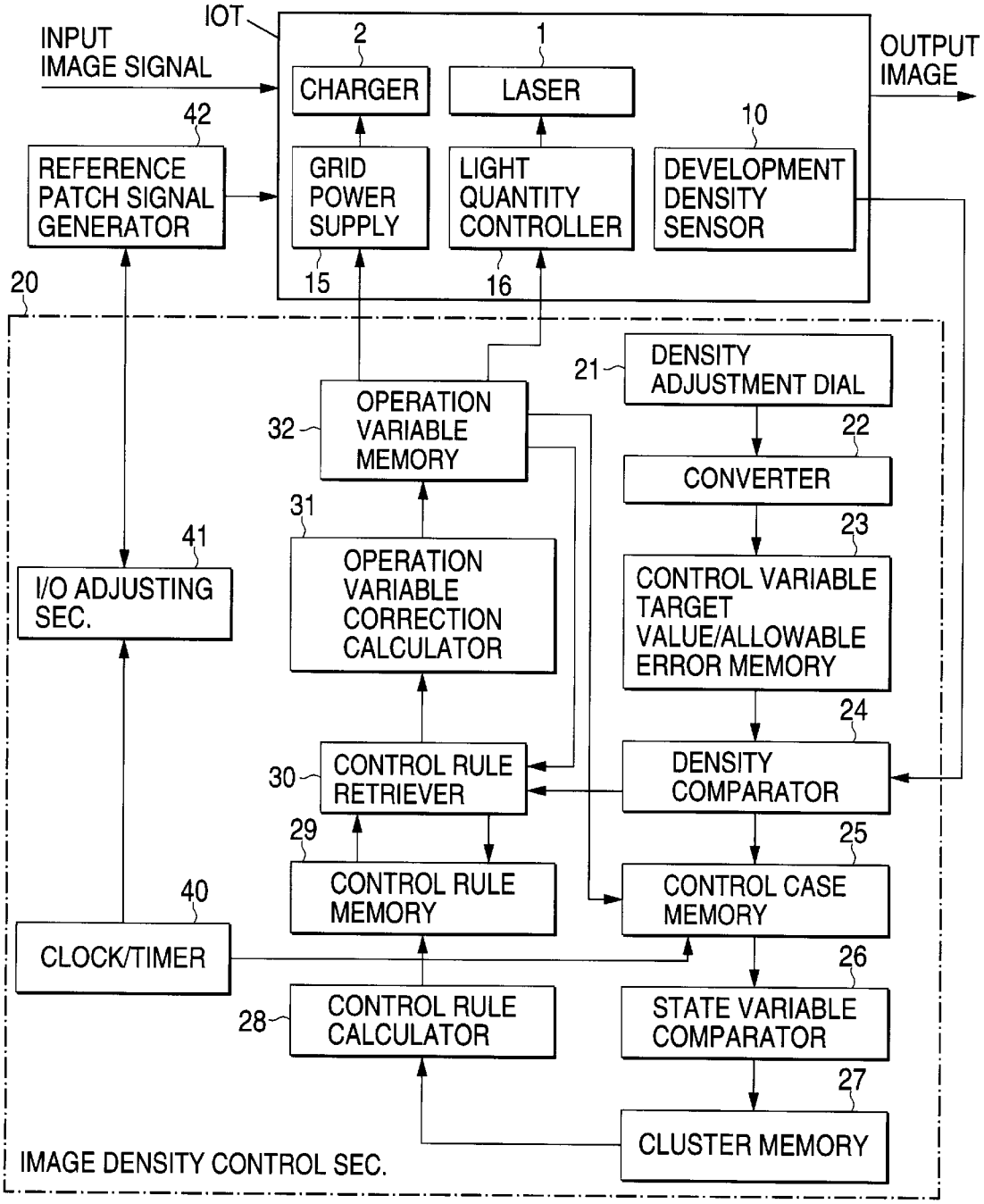
FIG. 6 is a block diagram illustrating an image density control section 20 used in the first and second embodiments of the present invention.

Next, FIG. 6 is a block diagram illustrating a configuration of an image density control section 20 for controlling the density of an image by controlling the scorotron charger 3 and the laser output unit 1. In the drawing, reference numeral 21 denotes a density adjustment dial, and an operator sets a value corresponding to a desired density. By means of a converter 22, the set value of the density adjustment dial 21 is converted to a value (a value in the range of "0" to "255" in the case of this embodiment) calculated in terms of an output of the development density sensor 10. A target density outputted from the converter 22 is retained in a control variable memory 23. In this case, the control variable memory 23 stores an allowable error as well.

Meanwhile, an output signal from the development density sensor 10 and an output signal from the memory 23 are compared by a density comparator 24. In this comparison, the allowable error stored in the memory 23 is referred to. Then, the output signal from the development density sensor 10 is supplied to a control rule retriever 30 if the difference between the two output signals is within an allowable value, and to a control case memory 25 if it is greater than the allowable value.

The control case memory 25 is a memory for storing control cases, and stores state variables (typical values), operation variables, and control variables as a set. The reason that the control cases are thus stored is because, in this embodiment, various items of control are effected on the basis of the control cases stored in the past.

Here, the state variables stored in the control case memory 25 refer to the temperature and humidity exerting a dominant influence on the electrophotographic process, a variable of deterioration over time, and the like. Since these state variables can be regarded as being substantially constant within a limited time, in the case of this embodiment, the time (date, hour, minute, and second) of occurrence of the case and the number of images formed are used as their substitutes. If the time of occurrence is within a predetermined time unit (a predetermined time unit such as 3 minutes, 5 minutes, 10 minutes, or the like), the state of the image output section IOT is handled as being equivalent. This is because if the times of occurrence of the cases are close to each other, it can be expected that the cases are at substantially the same temperature and humidity, and that their degrees of deterioration are also approximately at the same level. In addition, the time data indicating the time occurrence in this embodiment is supplied from a clock/timer 40 shown in FIG. 6. Further, a determination can be made as to whether the state is the same on the basis of the cumulative number of sheets.

Next, the operation variables refer to quantities for adjusting parameters for changing output values of an object to be controlled. In the case of this embodiment, the operation variables include two types, a set value of grid voltage of the scorotron charger 3 (0 to 255; hereafter abbreviated as a scoro set value) and a set value of laser power (0 to 255; hereafter abbreviated as the LP set value). The reason that these two variables are selected as the operation variables is because the final image density which is to be controlled includes two portions, i.e., a solid density portion and a highlight density portion, and because the scoro set value and the LP set value have high correlations with the solid density and the highlight density.

In addition, the scoro set value and the LP set value are respectively stored in an operation variable memory 32, and a value corresponding to an output signal from an operation-variable correction calculator 31 is read out, as required. Then, the scoro set value which has been read out from the operation variable memory 32 is supplied to a grid power supply 15, whereby the grid power supply 15 applies a voltage corresponding to the scoro set value to the scorotron charger 3. Meanwhile, the LP set value which has been read out from the operation variable memory 32 is supplied to a light quantity controller 16, whereby the light quantity controller 16 imparts laser power corresponding to the LP set value to the laser output unit 1.

Next, the control variables supplied to the control case memory 25 are output signals from the development density sensor 10. As a result, for example, control cases such as those shown in FIG. 7 are stored in the control memory 25. In this table, as for case 1 in cluster 1, the state variable (time of occurrence) is 1995, December 1, 12 hours, 0 minute, and 10 seconds, the LP set value is "83," the scoro set value is "130," and the control variable (sensor output value) is "185" for the solid portion and "12" for the highlight portion. As for case 1 in cluster 2, the state variable is 1995, December 2, 9 hours, 0 minute, and 5 seconds, the LP set value is "148," the scoro set value is "115," and the control variable is "185" for the solid portion and "30" for the highlight portion. Control rules are prepared for the respective clusters of control cases, as will be described later.

Next, a state variable controller 26, a cluster memory 27, and a control rule calculator 28 which are shown in FIG. 6 have the function of extracting control rules by referring to the control cases stored in the control case memory 25. Incidentally, as for the operation of these blocks, a detailed description will be given later.

In addition, a control rule memory 29 is a memory for storing a plurality of control rules calculated by the control rule calculator 28. If a request is made from the control rule retriever 30, the control rule memory 29 returns the control rules corresponding to the request. In this case, the control rule retriever 30 is arranged to request to the control rule memory 29 control rules corresponding to the density difference supplied from the density comparator 24 and the operation variables (i.e., the LP set value and the scoro set value) supplied from the operation variable memory 32. The control rule memory 29 stores coefficients (gains) of control rules, as shown in FIG. 8. Although the control case memory 25 described earlier stores cases for preparing the control rules, control rules other than the latest control rules are basically not used, the control case memory 25 resets data on the former clusters each time a new cluster of cases is prepared.

Next, the operation-variable correction calculator 31 determines correction values of control variables by using the control rules retrieved by the control rule retriever 30, and supplies the determined correction value to the operation variable memory 32. In a case where a control rule which is applied in determining a correction value of the operation variable (which may be a value of the operation variable itself) is to be expressed particularly explicitly, this control rule will be referred to as an application control rule. Thus, the operation variable memory 32 supplies the control variables corresponding to the correction values of the operation variables, i.e., the LP set value and the scoro set value, to the grid power supply 15 and the light quantity controller 16, respectively.

Meanwhile, a reference patch signal generator 42 is a circuit for instructing the preparation of the solid density patch PA1 and the highlight density patch PA2, and outputs a reference patch signal for proofreading to the image output section IOT at a patch-preparing timing. Consequently, the solid density patch PA1 and the highlight density patch PA2 shown in FIG. 3 are prepared.

In this case, the operation timing of the reference patch signal generator 42 is provided by an I/O adjusting section 41. The I/O adjusting section 41 monitors a time signal outputted by the clock/timer 40, and supplies an operation timing signal to the reference patch signal generator 42 such that the solid density patch PA1 and the highlight density patch PA2 are formed at predetermined positions.

[2.2] Initializing Operation

Figure 9:
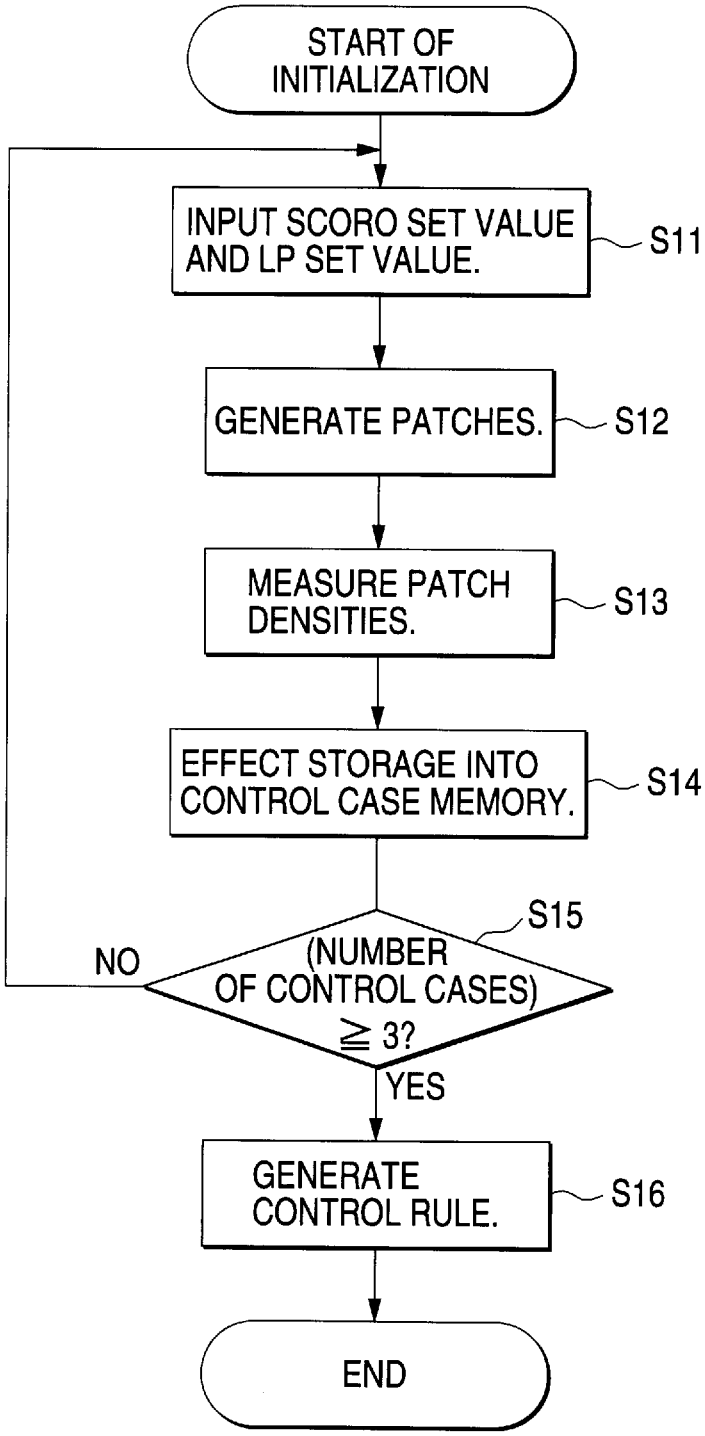
FIG. 9 is a flowchart explaining the operation at the time of initialization in the second embodiment.

Next, referring mainly to FIG. 9, a description will be given of the initialization processing (the so-called function setup processing) of image density control. First, a technician sets to appropriate values the scoro set value and the LP set value selected as controlling parameters (S11). Then, the image density control section 20 prepares the solid density patch PA1 and the highlight density patch PA2 (S12), measures their optical densities by the development density sensor 10 (S13), and stores the contents in the control case memory 25 as a control case (S14). Consequently, data on a first control case (control case 1) is stored in the control case memory 25.

Similarly, data on two more control cases is stored in the control case memory by varying the scoro set value and the LP set value, respectively. That is, the technician prepares a total of three sets of control cases at the time of setting up the control device (within the period of time when the state variables are equivalent), and allows the control case memory 25 to store the data thereon (S15).

When the three sets of control cases at the time of the initialization are stored in the control case memory 26, its stored contents are supplied to the control rule calculator 28 via the state variable comparator 26 and the cluster memory 27, and control rules are determined there. The control rules in this case are extracted as a control case plane such as the one shown in FIG. 10 (S16). Incidentally, independent three sets of control cases are necessary to determine the control case plane shown in FIG. 10. It goes without saying that four or more control cases may be used. In that case, an optimum control case plane is determined by using a mean square error method or the like. Incidentally, it is also possible to use control rules representing a curved surface, in addition to the control rules representing a plane.

Figure 10:
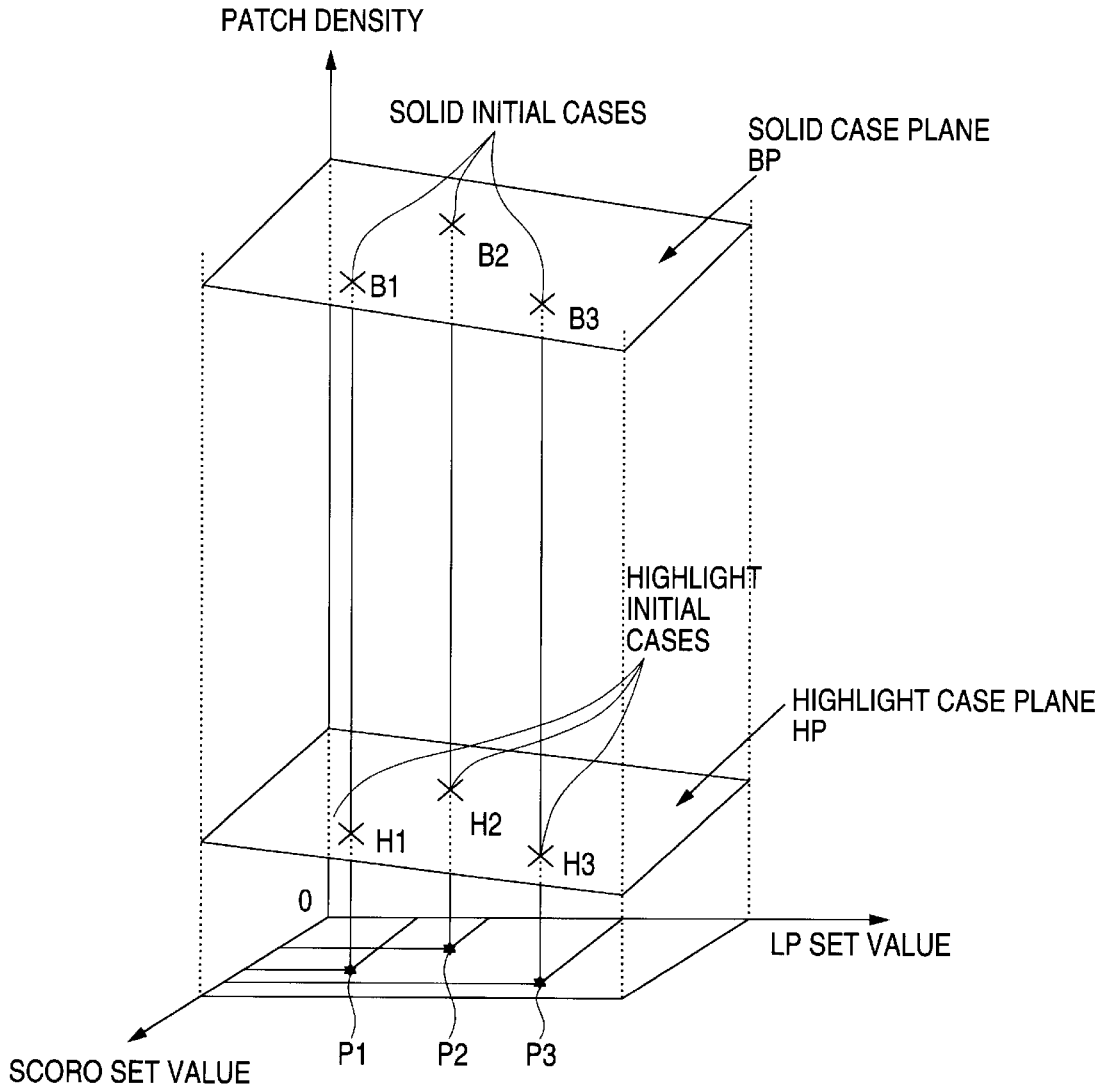
FIG. 10 is a diagram explaining the operation in FIG. 9.

In FIG. 10, P1, P2, and P3 are points which show combinations of the scoro set value and the LP set value concerning the three sets of control cases in the initialization. Here, it is assumed that points which indicate highlight densities (detected densities of the highlight density patch) corresponding to points P1, P2, and P3 are H1, H2, and H3, and that points which indicate solid densities (detected densities of the solid density patch) similarly corresponding to points P1, P2, and P3 are B1, B2, and B3. Then, a plane passing through the points B1, B2, and B3 is set as a solid case plane BP, while a plane passing through the points H1, H2, and H3 is set as a highlight case plane HP. Here, in a case where the state variables do not change, all the points which indicate the solid densities obtainable by appropriately changing the scoro set value and the LP set value are accommodated within the solid case plane BP. Similarly, in the case where the state variables do not change, all the points which indicate the highlight densities obtainable by appropriately changing the scoro set value and the LP set value are accommodated within the highlight case plane HP. Thus, the solid case plane BP and the highlight case plane HP show all the cases in the case where the state variables do not change. In other words, these planes show the control rules concerning the solid density and the highlight density at the time of initialization. Through the above-described processing, the initialization processing of image density control is completed.

Figure 11:
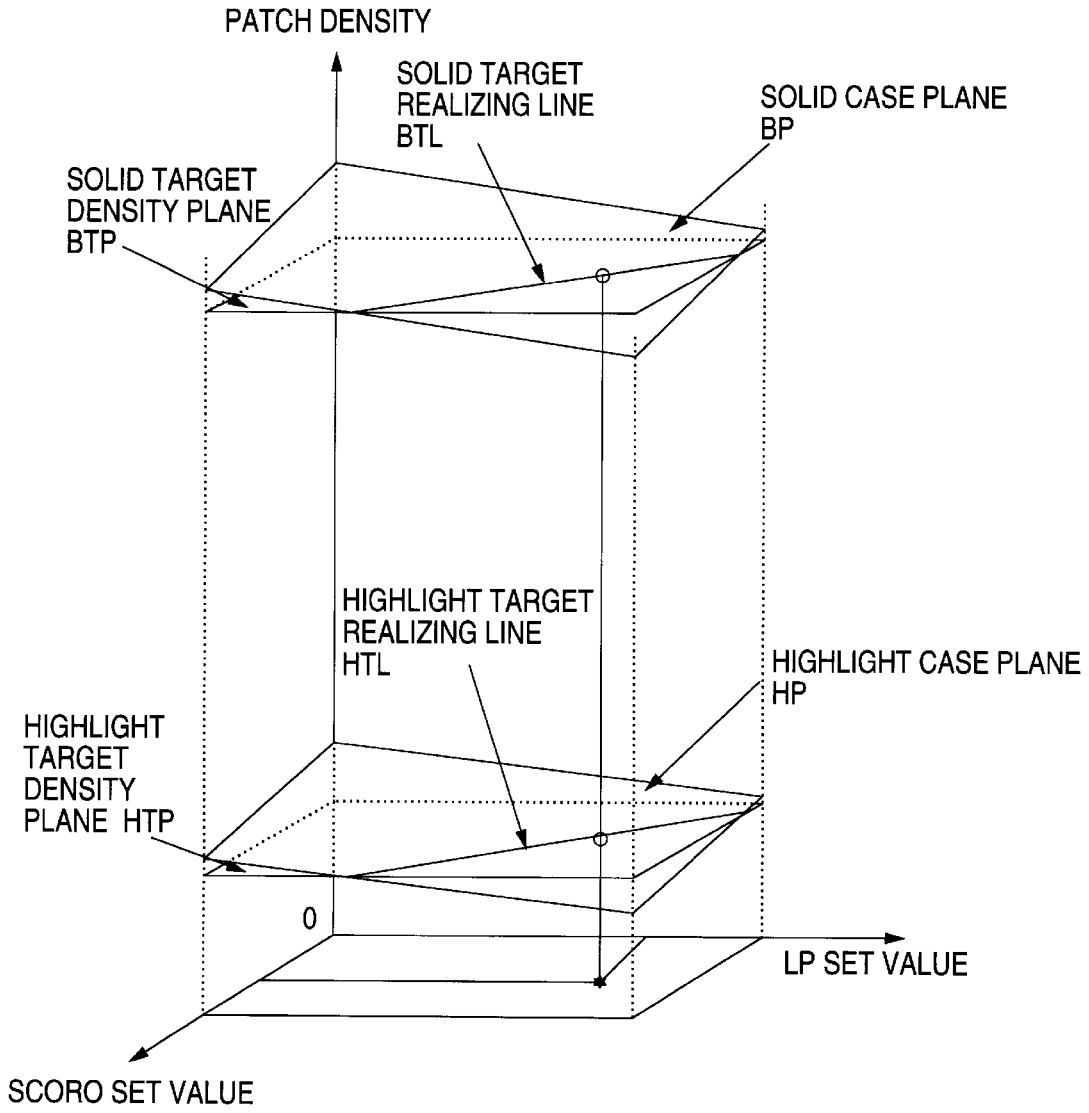
FIG. 11 is a diagram explaining the operation in FIG. 9.

If the control rules thus obtained are used, it is possible to uniformly determine the scoro set value and the LP set value concerning a target density. That is, when a value indicating a desired density is inputted from a user, the solid density (solid target density) and a highlight density (highlight target density) are calculated in correspondence with the indicated value. As shown in FIG. 11, a plane assuming the solid target density (solid target density plane BTP) and a plane assuming the highlight target density (highlight target density plane BTP) are respectively superposed on the solid case plane BP and the highlight case plane HP. A line of intersection BTL between the solid case plane BP and the solid target plane BTP is a set of points which satisfy the control rule concerning the solid density and assume the solid target density. Meanwhile, a line of intersection HTL between the highlight case plane HP and the highlight target plane HTP is a set of points which satisfy the control rule concerning the highlight density and assume the highlight target density. Then, a pair of the scoro set value and the LP set value which satisfies both lines of intersection BTL and HTL is determined. This pair of the scoro set value and the LP set value is an intersecting point of projection of the lines of intersection BTL and HTL onto a plane formed by the coordinate axis of the scoro set value and the coordinate axis of the LP set value.

This relationship can be shown by formulae which are given below. A control rule concerning the solid density and a control rule concerning the highlight density can be respectively expressed as $$D100=a1\cdot LP+a2\cdot SC+a3$$

$$D20=b1\cdot LP+b2\cdot SC+b3$$

where D100 is a solid density; D20 is a highlight density; LP is an LP set value; and SC is a scoro set value. Further, a1, a2, a3, b1, b2, and b3 are coefficients. If the above formulae are solved with respect to the scoro set value SC and the LP set value LP, we have $$SC=(b1\cdot D100-a1\cdot D20-a3\cdot b1+a1\cdot b3)/(a2\cdot b1-a1\cdot b2)$$

$$LP=(b2\cdot D100-a2\cdot D20-a3\cdot b2+a2\cdot b3)/(a1\cdot b2-a2\cdot b1)$$

If the solid target density and the highlight target density are substituted into D100 and D20 of these formulae, LP and SC can be determined.

In a case where the solid density and the highlight density of a case which satisfy the control rules have been measured in advance, the scoro set value and the LP set value can be determined on the basis of the solid density and the highlight density. That is, $$\Delta D100=a1\cdot\Delta LP+a2\cdot\Delta SC$$

$$\Delta D20=b1\cdot\Delta LP+b2\cdot\Delta SC$$

where ΔD100 is a difference between the solid density of the case and the target solid density; ΔD20 is a difference between the highlight density of the case and the target solid density; ΔLP is a difference between the LP set value of the case and a next LP set value; and ΔSC is a difference between the scoro set value of the case and a next scoro set value. If the above formulae are solved with respect to the difference ΔSC of the scoro set value and the difference ΔLP of the LP set value, we have $$\Delta SC=(b1\cdot\Delta D100-a1\cdot\Delta D20)/(a2\cdot b1-a1\cdot b2)$$

$$\Delta LP=(b2\cdot\Delta D100-a2\cdot\Delta D20)/(a1\cdot b2-a2\cdot b1)$$

If ΔD100 and ΔD20 are substituted into these formulae, ΔLP and ΔSC are determined, so that the next scoro set value and LP set value can be determined.

The control rules can be expressed by the coefficients a1, a2, a3, b1, b2, and b3 or the coefficients a1, a2, b1, and b2.

[2.3] Basic Operation

Figure 12:
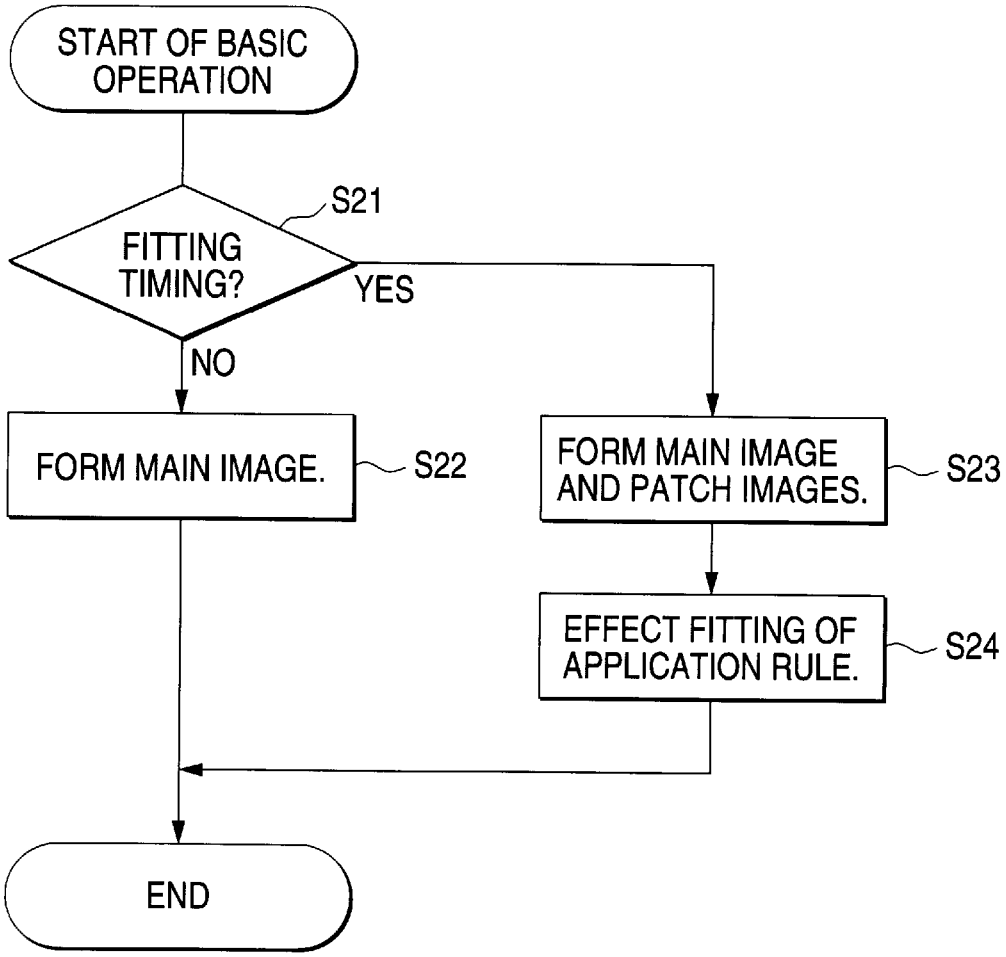
FIG. 12 is a flowchart explaining the basic operation after the initialization.

Next, a description will be given of the operation after initialization. As shown in FIG. 12, the operation after initialization consists of an image forming operation (S22 and S23) and an operation of fitting application rules (S24). The image forming operation is a usual image-forming operation in the electrophotographic system. The operation of fitting application rules is an operation whereby rules which are applied in controlling the image density are fitted. The fitting operation can be effected by forming patch images and by measuring their image densities. Its details will be described later. In this example, since images of the patches can be formed simultaneously with the main image (FIG. 4), at the fitting timing the images of the patches are formed in addition to the main image (S21, S22). The fitting timing can be set arbitrarily, and can be provided each time a predetermined number of the main images are formed, for example. The fitting timing can be provided each time the main image is formed or each time 10 main images are formed. Alternatively, the fitting timing can be provided after the lapse of a predetermined time or in correspondence with the occurrence of a predetermined event.

Figure 13:
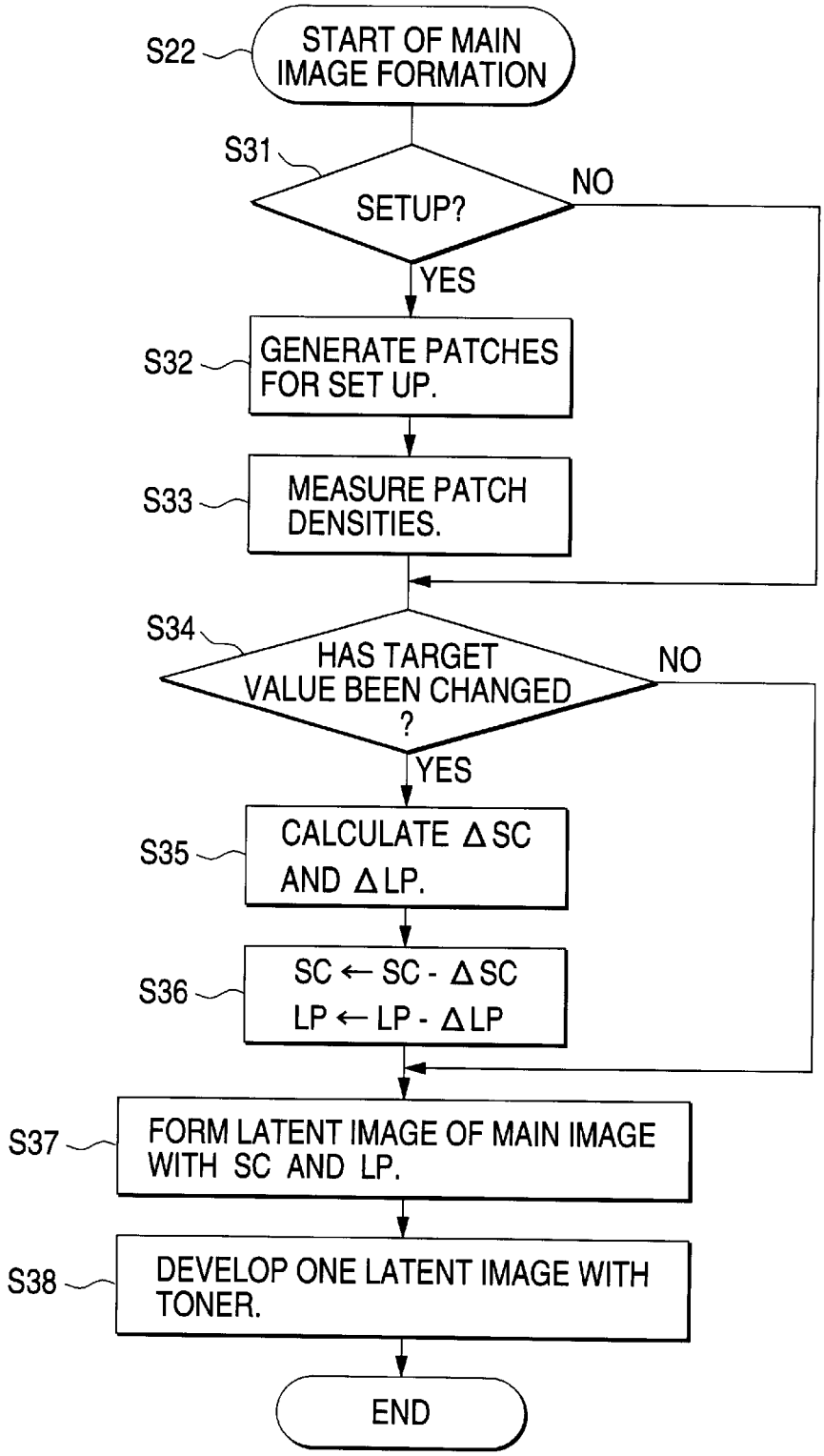
FIG. 13 is a flowchart explaining the processing of forming a main image in FIG. 12.

The operation of forming the main image (S22) is effected as shown in FIG. 13. First, a determination is made as to whether or not the power supply has been turned on immediately before (S31). When the power supply is turned on, measured solid and highlight densities are not available, a solid density patch and a highlight density patch for set up are formed (S32). As the scoro set value and the LP set value at this time, the previous (immediately before the turning off of power supply) values may be used, or default values may be used. Densities of the solid density patch and the highlight density patch which have been formed are measured by the image density sensor 10 (S33).

Next, a determination is made as to whether or not the density target values have been changed by the user (S34). If they have not been changed, the latent image of the main image is formed with the present scoro set value and LP set value (S37), and the latent image is developed with the toner (S38). If the target values have been changed, the solid density and the highlight density corresponding to the target values are calculated, and the differences ΔD100 and ΔD20 with respect to the solid density and the highlight density measured immediately before are calculated. The control rules which are applied to the present state are set as $$\Delta D100=a1\cdot\Delta LP+a2\cdot\Delta SC$$

$$\Delta D20=b1\cdot\Delta LP+b2\cdot\Delta SC.$$

The aforementioned differences ΔD100 and ΔD20 are substituted into these formulae to calculate ΔLP and ΔSC (S35). These values ΔLP and ΔSC are subtracted from the present LP set value LP and scoro set value SC to set a new LP set value and scoro set value (S36). Then, the latent image of the main image is formed with the new LP set value and scoro set value, and the latent image is developed with the toner (S37, S38).

Figure 14:
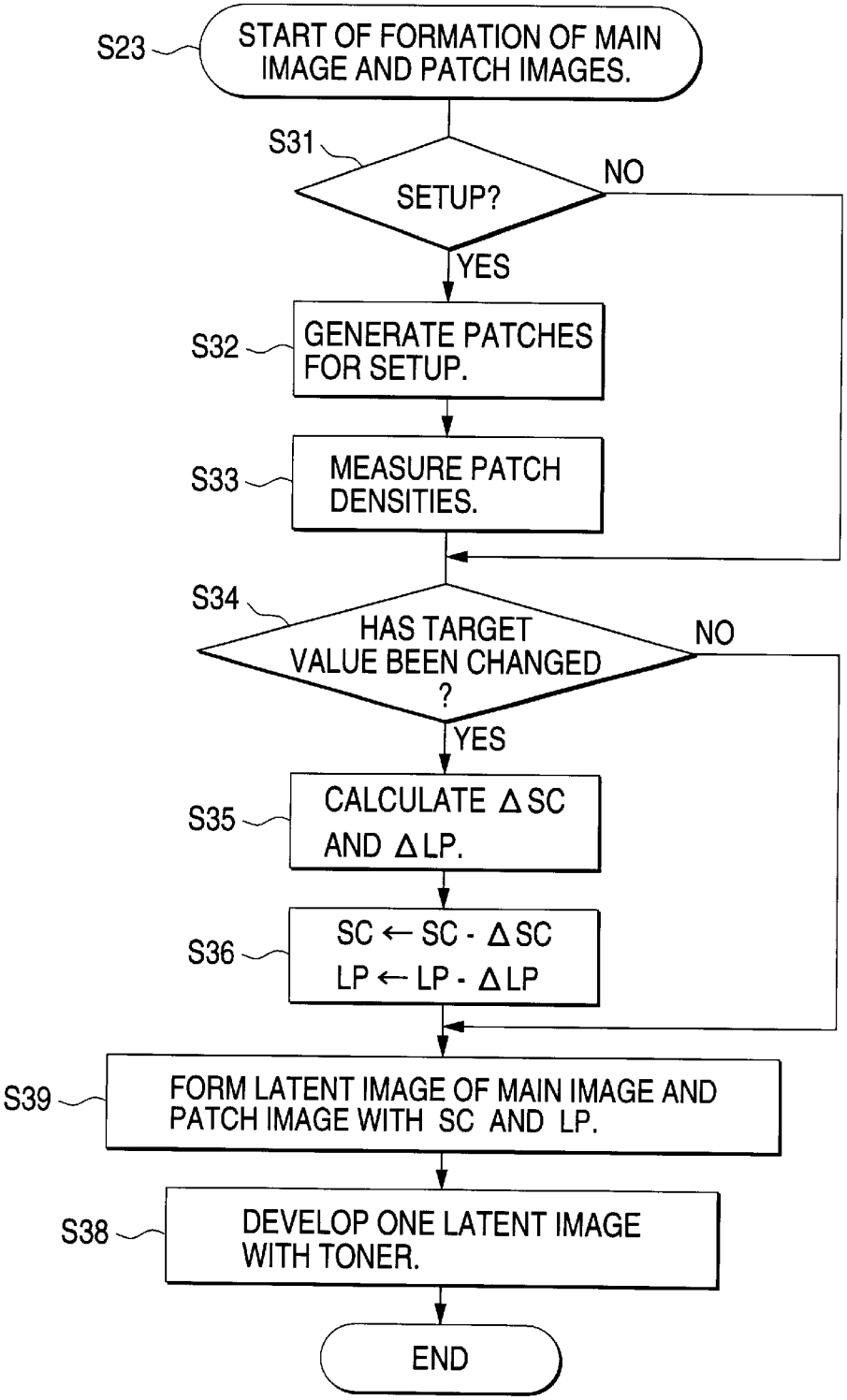
FIG. 14 is a flowchart explaining the processing of forming a main image and patch images in FIG. 12.

The operation of forming the main image and the patch images (S23) is shown in FIG. 14. This operation is substantially similar to that shown in FIG. 13, so that corresponding steps will be denoted by corresponding numbers, and a detailed description thereof will be omitted. In brief, in the operation of forming the main image and the patch images (S23), the latent images of the patch images are formed in addition to the main image in Step S39.

Figure 15:
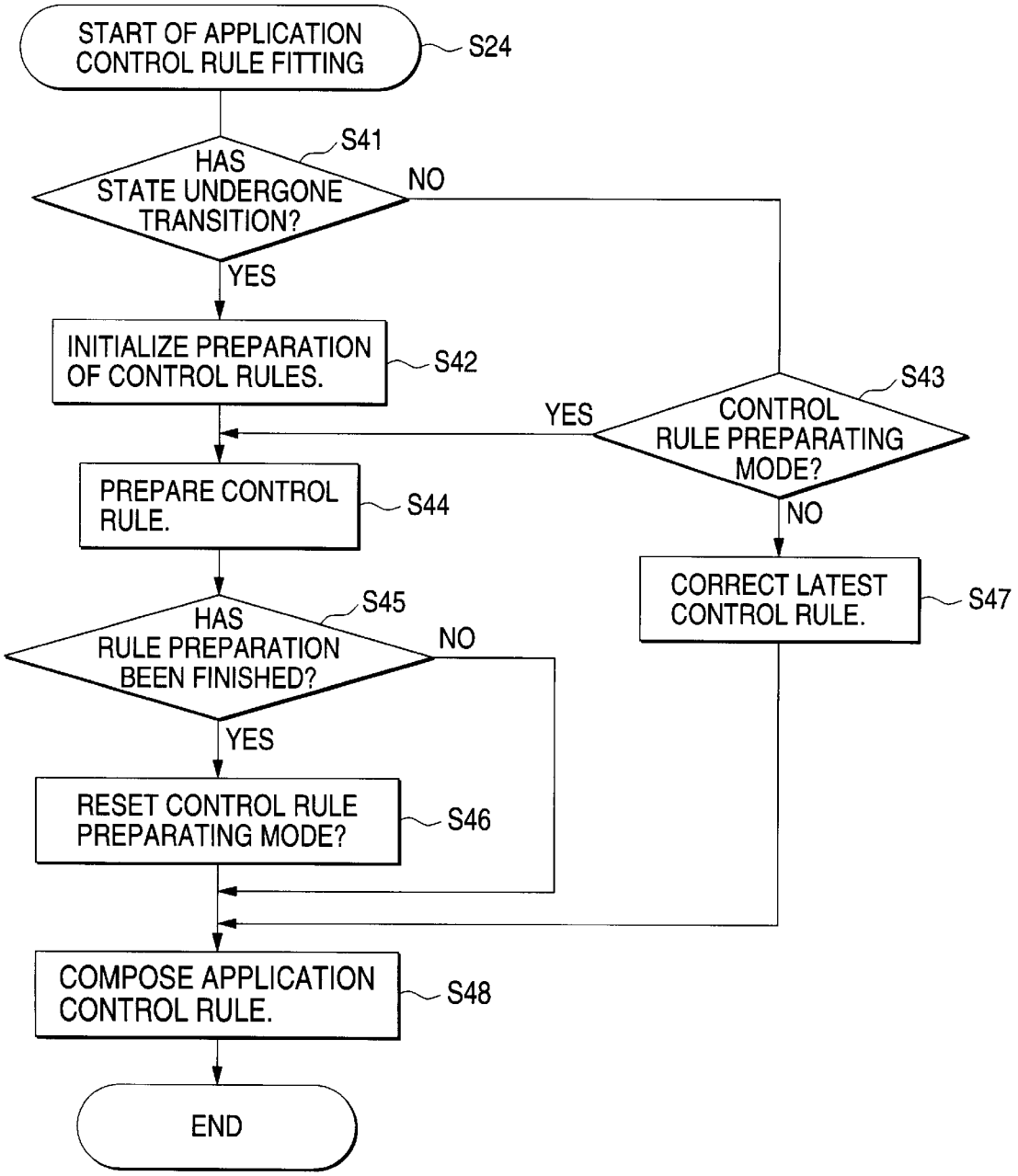
FIG. 15 is a flowchart explaining the processing of fitting application control rules in FIG. 12.

As shown in FIG. 15, the operation of fitting application rules consists of the following: the operation (S47) of correcting the latest control rules in which the latest control rules corresponding to the present state are corrected, the operation (S42) of preparing control rules in which new control rules corresponding to a new state are prepared after transition of the state, and the operation (S48) of composing application rules in which optimum control rules are composed from one or more control rules which are presently stored.

In FIG. 15, a determination is first made as to whether or not the state of the main body of the image forming apparatus has undergone a transition (S41). Whether or not the state of the main body of the image forming apparatus has undergone a transition is determined on the basis of the time of image formation and the cumulative number of images. When a predetermined time duration has elapsed, or after a predetermined number of images have been formed, the probability of the state of the main body of the image forming apparatus having undergone a transition is high, so that such substitute values can be used. This determination can be made on the basis of a specific state variable of the main body of the image forming apparatus, such as the temperature, humidity, or the like, or another substitute value of the state variable may be used.

When the state has undergone a transition, the rule-preparing operation (on the case data and the like being stored) is initialized (S41, S42). In the rule-preparing step S44, when data on cases after the transition of the state has been stored, and data on cases in a number sufficient for preparing control rules for a new state has been stored, new control rules are prepared. When the control rules have been prepared, the rule-preparing operation is finished, and the control-rule preparing mode is reset (S45, S46). If the state has not undergone a transition, a determination is made as to whether or not the present operation is in the control-rule preparing mode (S43). If the present operation is in the control-rule preparing mode, the control-rule preparing operation is effected (S44). If the present operation is not in the control-rule preparing mode, i.e., if, after transition of the state, new control rules corresponding to that state have already been prepared, the operation of correcting the control rules is effected (Step S47).

Through the above-described operation, the control rule preparation is initialized each time the state undergoes a transition, and control rules are generated when a sufficient number of cases are stored during the continuation of that state. Accordingly, a plurality of control rules are usually prepared. A maximum number of control rules may be determined in advance, and when the maximum number of control rules have been prepared, the control rules may be updated according to a predetermined rule.

In the operation of composing application rules (S48), the goodness of fit between the present state and each control rule is calculated, and the respective control rules are weighted and combined in correspondence with the goodness of fit, thereby composing application rules which are applied in the subsequent image formation. The goodness of fit can be selected such that, for instance, the smaller the deviation between the density of a patch formed immediately before and a density at a time when the scoro set value and the LP set value at the time of its formation are applied to the control rules, the larger the goodness of fit.

For example, if it is assumed that the deviation of the solid density of a control rule Ri (i is a positive integer) is E100, i, and the deviation of the highlight density is E20, i, then the goodness of fit of the solid density w100, i and the goodness of fit w20, i of the highlight density become $$w100,\ i=(1/E100,\ i)/(\Sigma(1/E100,\ j))$$

$$w20,\ i=(1/E20,\ i)/(\Sigma(1/E20,\ j))$$

(where Σ means a total sum concerning j), so that the overall goodness of fit, wi, becomes such that wi=w100, i×w20, i.

Figure 16:
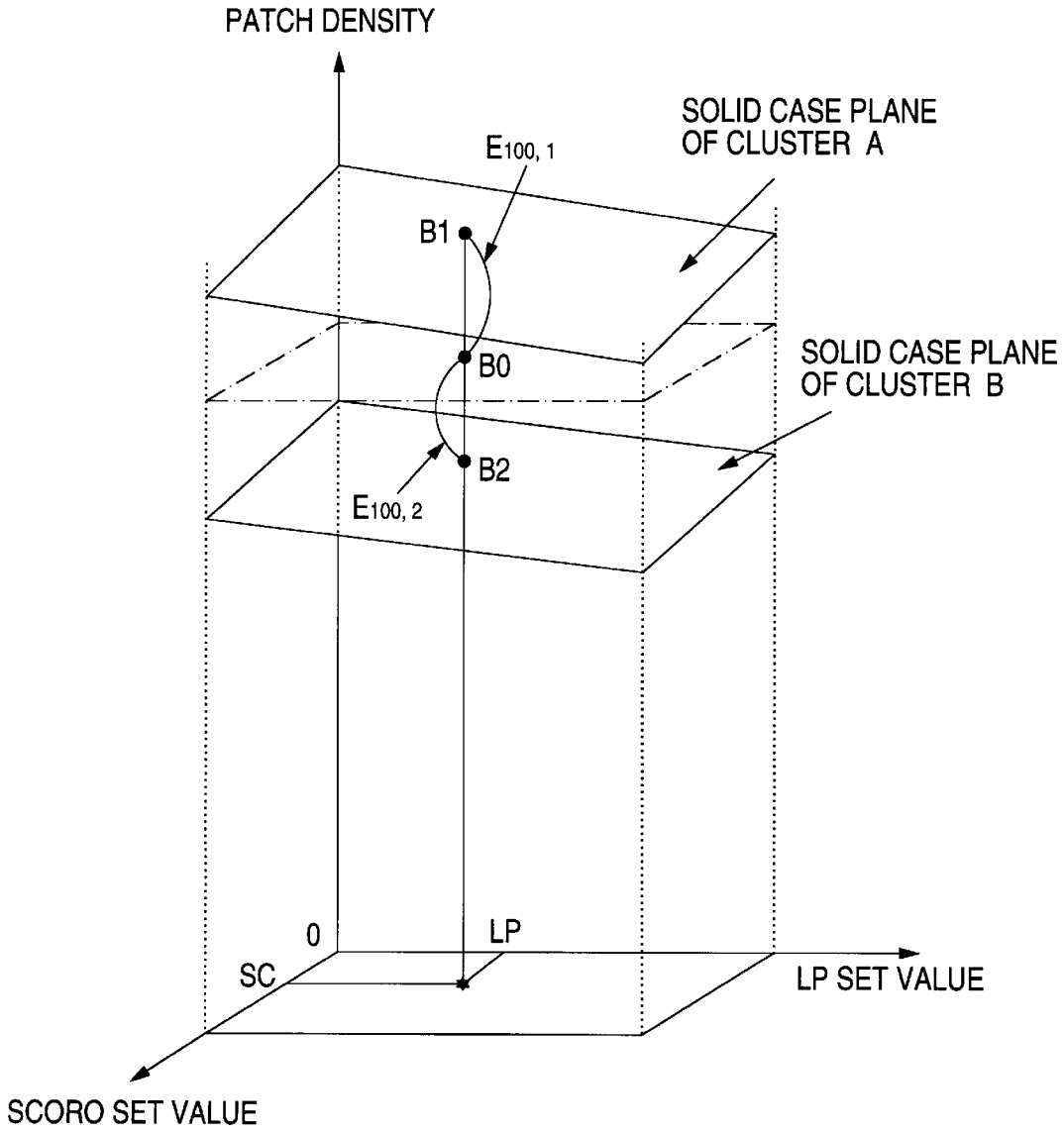
FIG. 16 is a diagram explaining the operation of FIG. 15.

FIG. 16 shows an example in which the goodness of fit w100, i with respect to solid case planes of a cluster A and a cluster B is calculated. In the drawing, it is assumed that an actual solid patch density at a time when the present scoro set value and LP set value are SC and LP, respectively, is set as B0. It is also assumed that the solid patch density of the solid case plane of the cluster A at this time is B1, and the solid patch density of the solid case plane of the cluster B is B2. Then, the deviations E100, 1 and E100, 2 are |B0−B1| and |B0−B2|. If it is assumed that there are presently only two clusters, then w100, 1=(1/|B0−B1|)/(1/|B0−B1|+1/|B0−B2|), and w100, 2=(1/|B0−B2|)/(1/|B0−B1|+1/|B0−B2|). Similarly, the goodness of fit w100, 1 and w100, 2 of the highlight density is determined, and the overall goodness of fit w1 and w2 is obtained. This goodness of fit w1 and w2 is divided by the total sum (w1+w2), and is set as the normalized goodness of fit W1 and W2.

Thus, in this image density control, each time the state undergoes a transition, the operation of preparing new control rules which fit that state is commenced, and when sufficient cases are prepared, new control rules are generated. Accordingly, it is unnecessary to cope appropriately with various situations by collecting various data before shipment, allowing a substantial cost reduction. In addition, since various control rules are composed on the basis of the goodness of fit with respect to the situation which changes every hour, even a small number of control rules make it possible to cope appropriately with various situations. In this case, if, for example, control rules for coping with typical situations are incorporated in advance before shipment, it is possible to cope instantly with the various situations. If these typical control rules are made unupdatable in the storage management of the control rules, such typical control rules are prevented from becoming deleted when new control rules are registered.

[2.4] Detailed Control Flow of Fitting Application Control Rules

Referring next to FIGS. 17 to 22, a description will be given of a detailed example of controlling the fitting of application control rules (S24).

Figure 17:
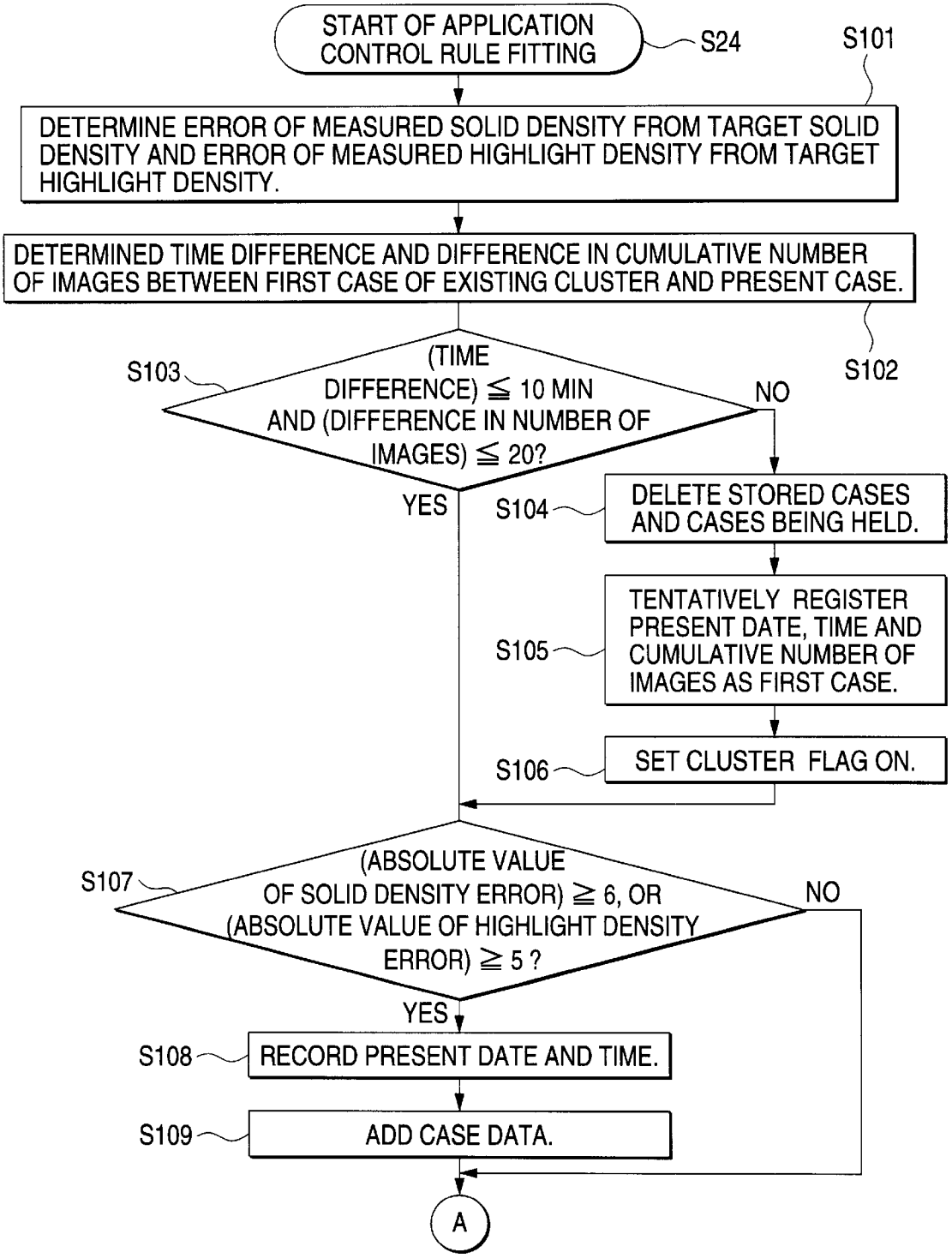
FIG. 17 is a flowchart explaining more detailed processing of the operation of FIG. 15.
Figure 18:
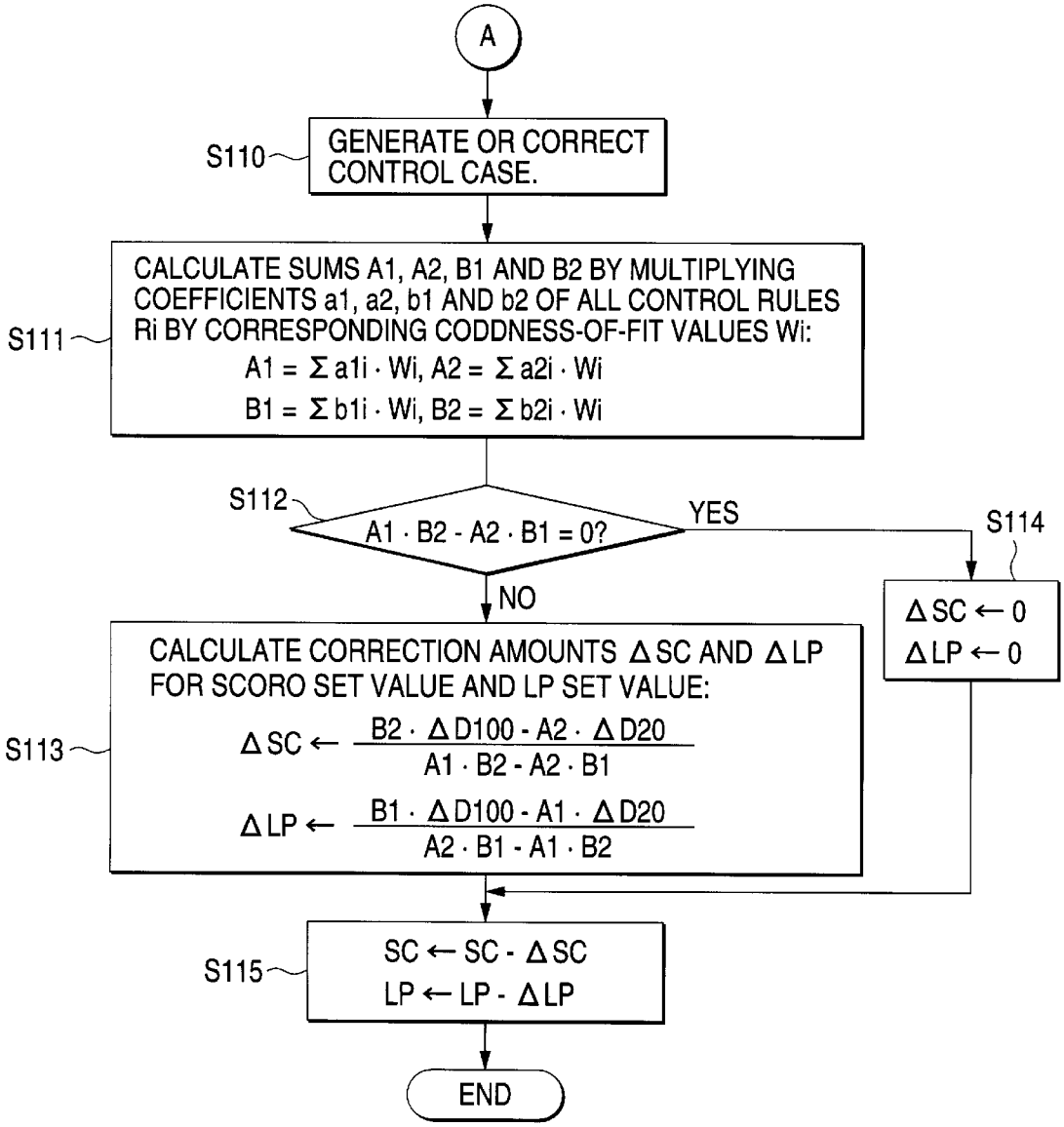
FIG. 18 is a flowchart explaining more detailed processing of the operation of FIG. 15.

First, referring to FIGS. 17 and 18, a description will be given of the overall flow of the fitting of application control rules.

[Step S101] An error E100 between the measured solid density and the target solid density is determined. Similarly, an error between the measured density of the highlight density patch and the target highlight density E20 is determined.

[Step S102] Differences between, on the one hand, the time of the existing first case and the cumulative number of images and, on the other hand, the present time and the cumulative number of images are calculated.

[Step S103] A check is made as to whether or not the time difference is not more than 10 minutes and the difference in the cumulative number of images is not more than 20 sheets. If the time difference is not more than 10 minutes and the difference in the cumulative number of images is not more than 20 sheets, a determination is made that the state has not undergone a transition, and the operation proceeds to the operation of correcting the present control rules. If the time difference exceeds more than 10 minutes, or the difference in the cumulative number of images exceeds 20 sheets, a determination is made that the state has undergone a transition, so that the operation proceeds to the mode of preparing new control rules (Steps S104, S105, S106).

[Steps S104 to S106] This is the operation of generating new control rules in correspondence with the determination of the transition of the state. First, the cases which were stored in the state prior to the transition as well as saved cases are deleted (S104). Then, the present data, time, and the cumulative number of images are tentatively registered as a first case (S105). Then, a cluster-preparing flag is set (S106). Here, the cluster refers to a cluster of cases which are detected in one state, and control rules for that state are prepared on the basis of data on the cases included in the cluster. The fact that the cluster-preparing flag is on indicates that the operation is in the mode of preparing new control rules.

[Steps S107 to S109] In the series of these steps, if a noticeable case occurs, that noticeable case is added as a case. The noticeable case refers to a case which must be taken into consideration in the preparation of new rules or a case which must be taken into consideration in correcting the present control rules. In this case, the noticeable case is a case in which either the present solid density error or highlight density error has exceeded an allowable error. First, in Step S107, a determination is made as to whether or not the density errors are within allowable error ranges. The allowable error is 6 level in the case of the solid density, and 5 level in the case of the highlight density. If the density error exceeds the allowable error, after the present date and time are recorded, and data on the case is stored (S108, S109), the operation proceeds to Step S110 for preparing and correcting control rules. As for the recording of data on the case, a detailed description will be given later by referring to FIG. 19. If the errors are within the allowable error ranges, the operation directly proceeds to Step S110 for preparing and correcting control rules.

[Step S110] In the step of preparing and correcting the control rules, if the state has undergone a transition, new control rules are prepared, and if the state has not undergone a transition, the control rules which were prepared in that state are corrected. In addition, the goodness of fit is calculated concerning the control rules. As for the details of preparation and correction of the control rules, a detailed description will be given later by referring to FIGS. 20 and 21.

[Step S111] The total sums A1, A2, B1, and B2 in which the coefficients a1, a2, b1, and b2 of all the control rules Ri are multiplied by the goodness of fit Wi of the control rules are determined, and they are set as coefficients of the application control rules. That is, correction amounts ΔSC and ΔLP of the operation variables are determined on the basis of the deviations ΔD60 and ΔD20.

$$\Delta D60=A1\cdot\Delta SC+A2\cdot\Delta LP$$

$$\Delta D20=B1\cdot\Delta SC+B2\cdot\Delta LP$$

If the above formulae are solved with respect to ΔSC and ΔLP, we have $$\Delta SC=(B2\cdot\Delta D60-A2\cdot\Delta D20)/(A1\cdot B4-A2\cdot B1)$$

$$\Delta LP=(B1\cdot\Delta D60-A1\cdot\Delta D20)/(A2\cdot B1-A1\cdot B2)$$

where $$A1=\Sigma a1i\cdot Wi$$

$$A2=\Sigma a2i\cdot Wi$$

$$B1=\Sigma b1i\cdot Wi$$

$$B2=\Sigma b2i\cdot Wi.$$

Here, Σ means a total sum concerning i.

[Steps S112 to S114] A determination is made as to whether or not a correction amount can be determined (S112). Namely, in a case where A1·B2−A2·B1 assumes a zero value, i.e., in a case where the solid density plane and the highlight density plane of the composed application control rules are parallel, solutions for ΔSC and ΔLP cannot be determined, so that the correction amount is set to be zero, and the previous scoro set value and LP set value are used as they are (S114). If solutions can be determined, ΔSC and ΔLP are determined from the above formulae (S113).

[Step S115] The scoro set value and the LP set value are corrected on the basis of ΔSC and ΔLP determined above.

Figure 19:
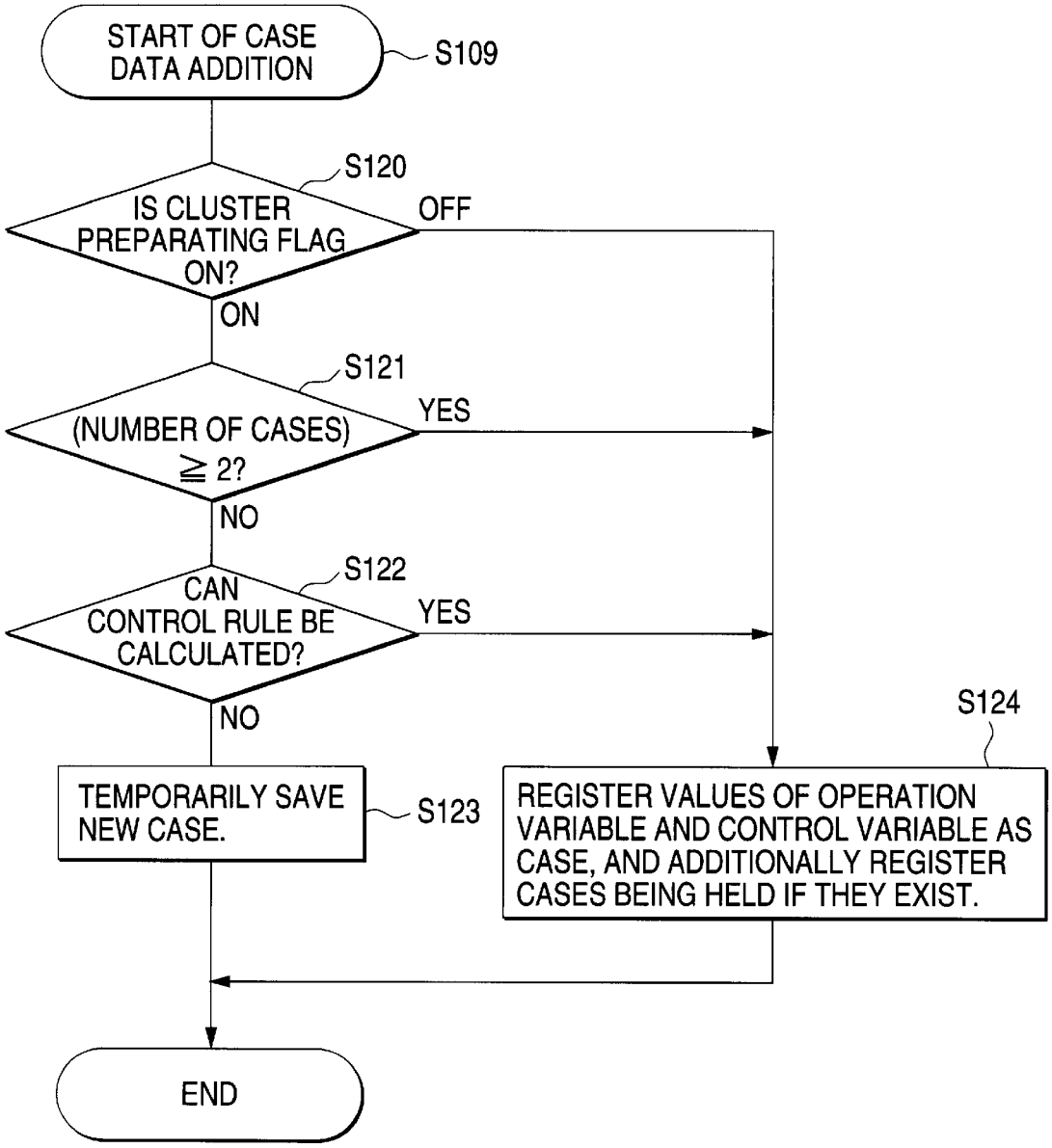
FIG. 19 is a flowchart illustrating details of the processing of addition of case data in FIG. 17.
Figure 20:
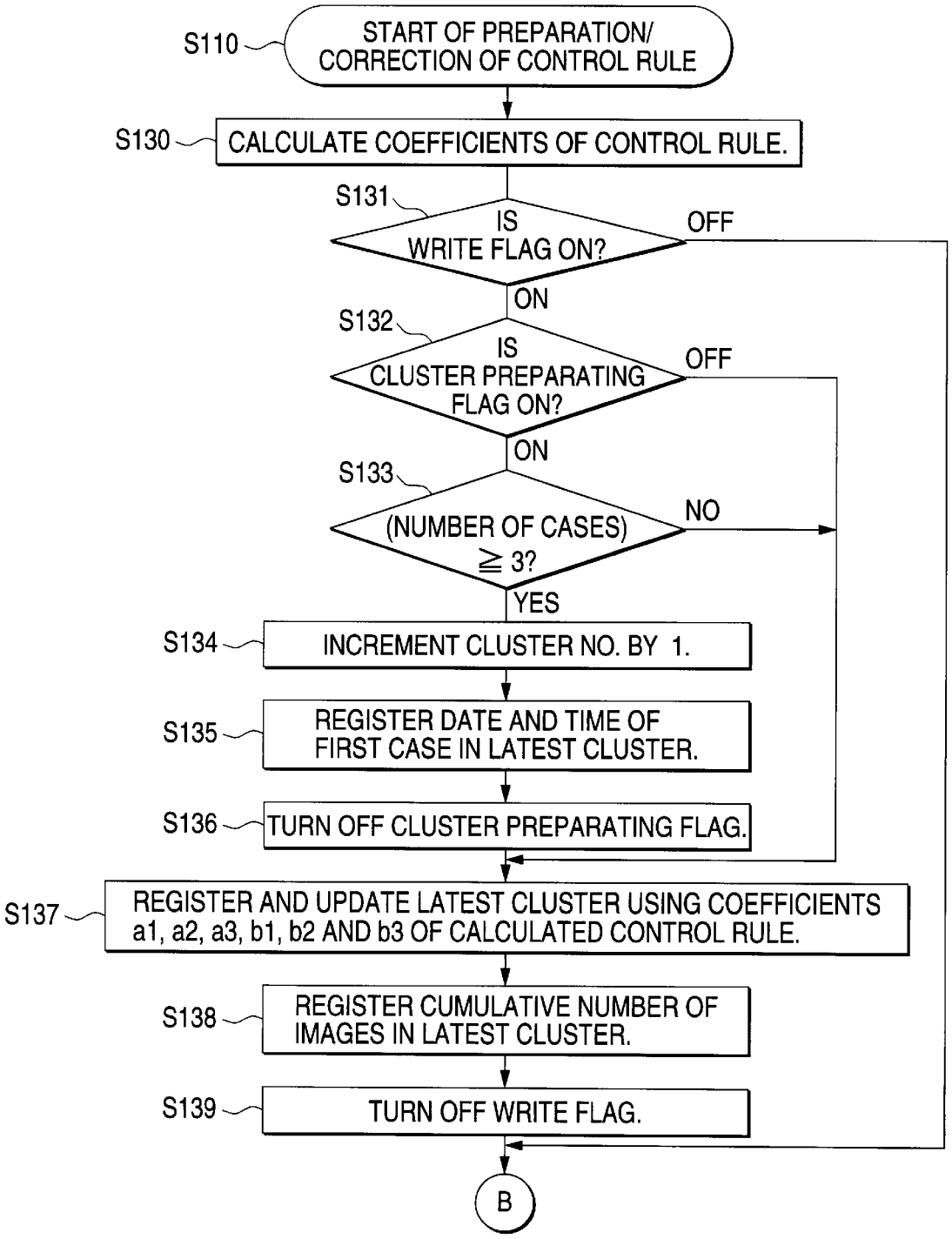
FIG. 20 is a flowchart illustrating details of preparation and correction of control rules in FIG. 18.
Figure 21:
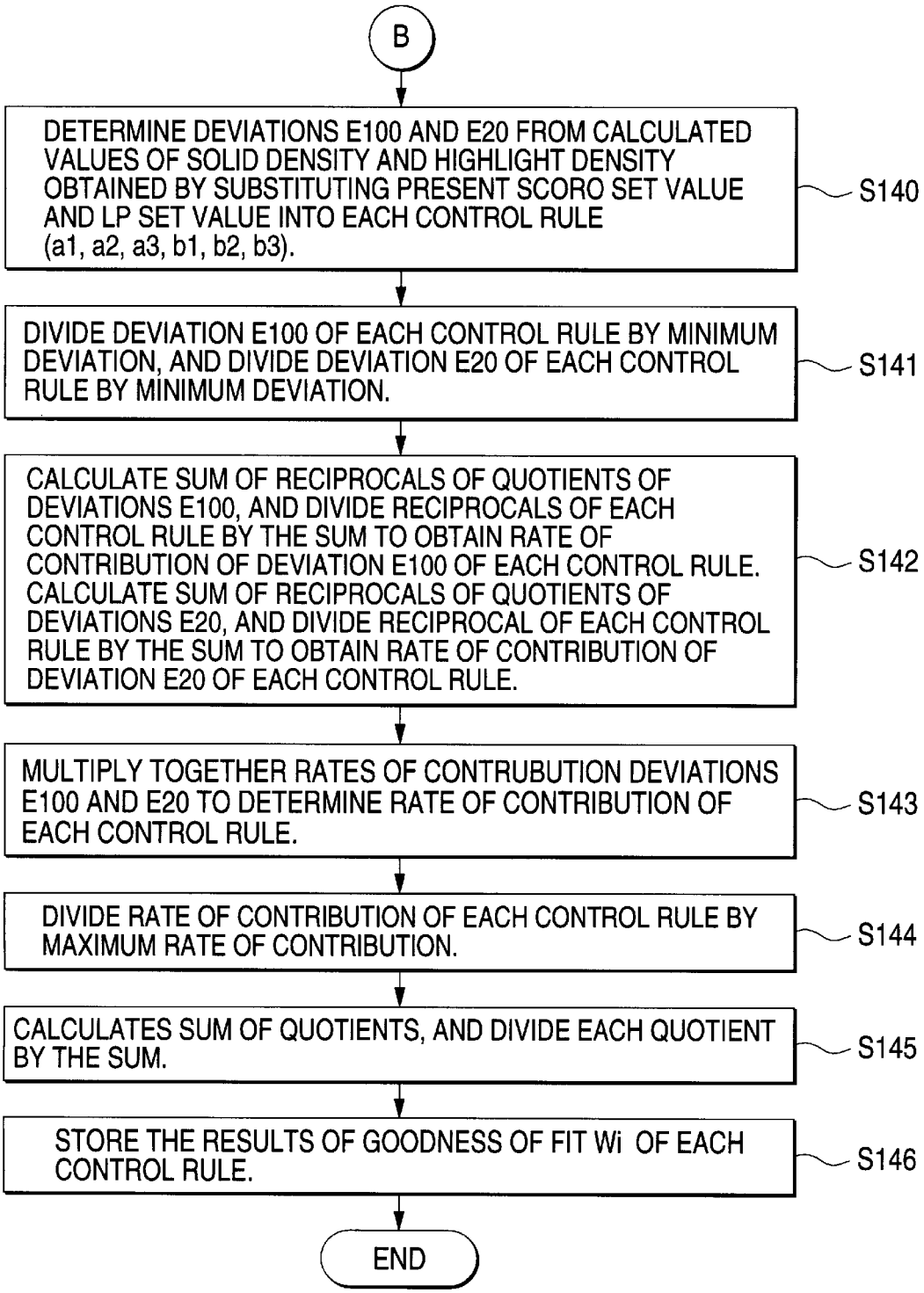
FIG. 21 is a flowchart illustrating details of preparation and correction of control rules in FIG. 18.

Next, referring to FIG. 19, a description will be given of the operation of storing data on a noticeable case (S109).

[Step S120] A check is made as to whether or not the cluster-preparing flag is on. If the cluster-preparing flag is off, i.e., if the state has not undergone a transition, and if data on a noticeable case is obtained, this noticeable case is stored, and is used to correct the control rules in that state.

[Steps S121 to S122] If the cluster-preparing flag is on, a check is made as to whether or not two or more noticeable cases have been stored up until then (S121). If the number is less than 2, the operation proceeds to Step S124 to store data on the cases. If the number of cases is 2 or more, a check is made in Step S122 as to whether or not control rules can be calculated. If the case of this embodiment, if 3 cases are provided, rules can be normally prepared, but if data on 3 cases are arranged on a straight line, it is impossible to define the plane of the control rule, so that the control rules cannot be calculated. In such a case, the new case is not stored, but is saved as a saved case (S123). The data on this saved case is utilized as supplementary data when data on cases in a number sufficient for preparing control rules are gathered later.

[Step S124] Values of operation variables (the scoro set value and the LP set value) and values of control variables (the solid density and the highlight density) are recorded. In addition, the number of recorded cases is incremented by one. If there has been a case for saving, it is additionally registered.

In the above-described manner, the registration of a noticeable case is carried out.

Next, a description will be given of the operation of preparing and correcting control rules (S110).

[Step S130] The operation of preparing and correcting control rules first begins with the calculation of coefficients of control rules in the present state. As for this aspect, a detailed description will be given later by referring to FIG. 22. It should be noted that, in a case where the present control rules have been newly prepared or corrected, a write flag is set to a 1, and it is set to a 0 in other cases (see Step S153 in FIG. 22).

[Step S131] A check is made as to whether or not the write flag is on. If it is on, i.e., in the case where the control rules in the present state have been newly prepared or corrected, different processing is effected depending on whether new control rules have been prepared or the former control rules have been corrected. If the write flag is off, the operation proceeds directly to Step S140.

[Step S132] A check is made as to whether or not the cluster-preparing flag is on. If the cluster-preparing flag is on, i.e., when new control rules are to be prepared, the operation proceeds to Step S133, while if the cluster-preparing flag is off, i.e., if the control rules are to be corrected, the operation proceeds directly to Step S137.

[Step S133] A check is made as to whether or not the number of noticeable cases is 3 or more. If the number of noticeable cases is not 3 or more, control rules cannot be prepared newly, so that the operation proceeds to Step S137. If the number of noticeable cases is 3 or more, new rules can be prepared, so that the operation proceeds to Step S134.

[Steps S134 to S136] In Step S134, the cluster number, i.e., the rule number, is incremented by one. Next, in Step S135, the date and time of the first case in the cluster are registered in the latest cluster (control rule), and the cluster-preparing flag is reset in Step S136.

[Steps S137 to S139] The latest cluster (latest control rules) is registered and updated by using the control rules calculated in the rule-calculating step (S137). Subsequently, the cumulative number of images is registered in the latest cluster, and the write flag is reset (S138, S139).

[Steps S140 to S146] In this series of steps, the goodness of fit is determined with respect to a plurality of control rules, and application control rules are composed in correspondence with the goodness of fit. If there is only one control rule, that control rule is used as the application control rule as it is. First, the present scoro set value and LP set value are applied to each control rule, and the solid density and the highlight density of each control rule are calculated. Then, deviations with the solid density and the highlight density which are actually measured are calculated (S140). It is assumed that the deviation of the solid density is E60, and the deviation of the highlight density is E20. Then, the deviation E60 of the solid density of each control rule is divided by the deviation of a minimum solid density. Similarly, the density E20 of the highlight density of each control rule is divided by the deviation of a minimum highlight density (S141). Next, a total sum of values of the reciprocals of the divided values is determined with respect to the deviation of the solid density, and the reciprocal of each divided value is divided by this total sum so as to effect normalization. This normalized value will be referred to as a rate of contribution of the respective control rule with respect to the solid density. Similarly, a total sum of values of the reciprocals of the divided values is determined with respect to the deviation of the highlight density, and the reciprocal of each divided value is divided by this total sum so as to effect normalization. This normalized value will be referred to as a rate of contribution of the respective control rule with respect to the highlight density (S142). Subsequently, the rates of contribution of the solid density and the highlight density are multiplied by each other with respect to each control rule, so as to obtain a rate of contribution of that control rule (S143). Then, the rate of contribution of each control rule is divided by a maximum rate of contribution, and each resultant divided value is divided a total sum of the resultant divided values, so as to effect normalization (S144, S145). The values thus obtained are stored as the goodness of fit Wi of each control rule Ri.

In the above-described manner, the goodness of fit is calculated, and application control rules are determined. That is, total sums A1, A2, B1, and B2 in which the coefficients a1, a2, b1, and b2 of all the control rules Ri are multiplied by the goodness of fit of the respective control rule are obtained, and these total sums are set as coefficients of the application control rules.

$$A1=\Sigma wi\cdot a1i$$

$$A2=\Sigma wi\cdot a2i$$

$$B1=\Sigma wi\cdot b1i$$

$$B2=\Sigma wi\cdot b2i$$

where Σ is a total sum with respect to i.

Figure 22:
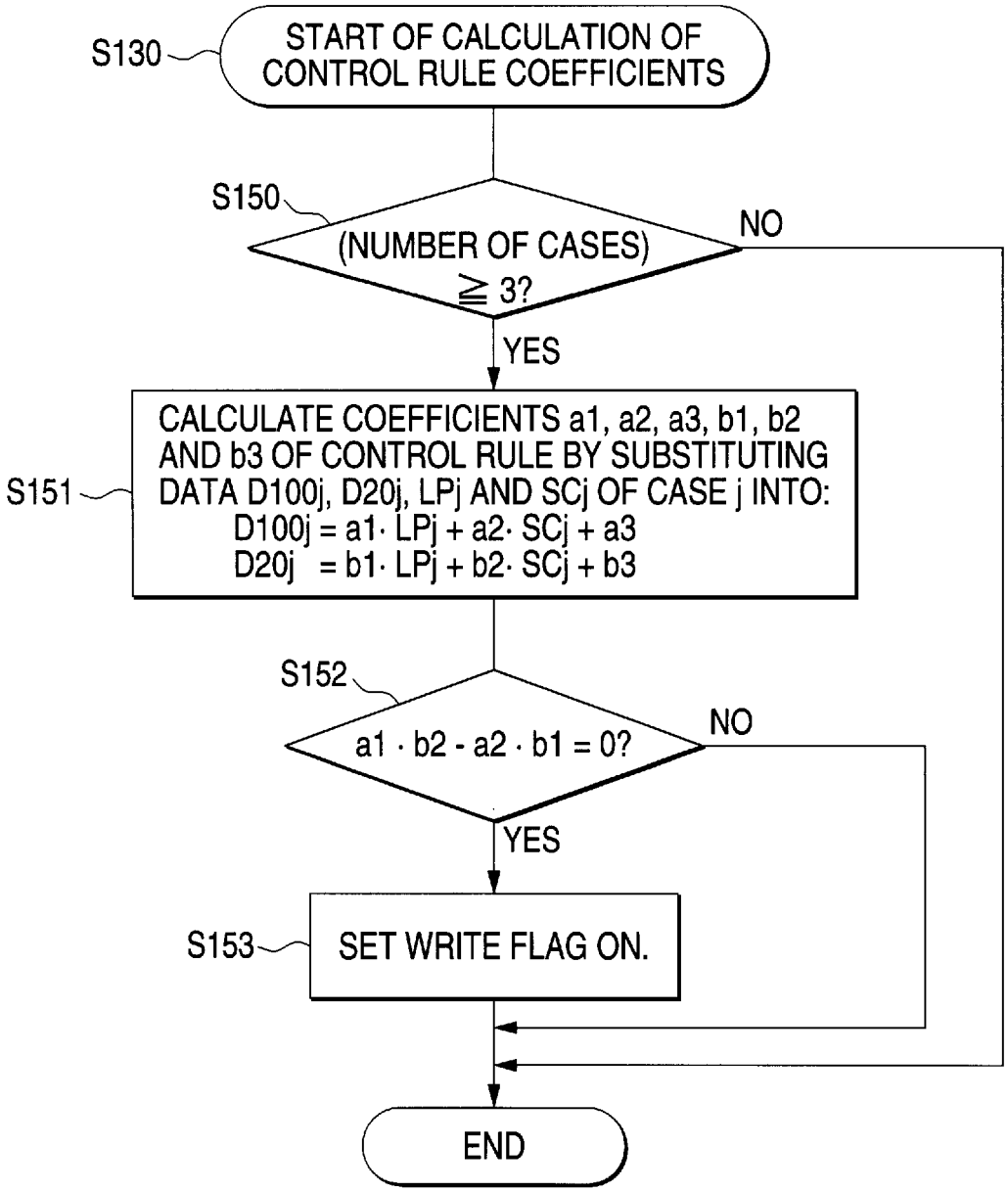
FIG. 22 is a flowchart illustrating details of the processing of calculating coefficients of control rules in FIG. 20.

Referring next to FIG. 22, a description will be given of the calculation of a control rule (S130).

[Step S150] First, a check is made as to whether or not the number of pieces of case data is 3 or more. If the number of pieces of case data is not 3 or more, the coefficients of the control rule cannot be calculated, so that the calculation processing ends. If the number of pieces of case data is 3 or more, the operation proceeds to Step S151.

[Step S151] The coefficients a1, a2, a3, b1, b2, and b3 of an optimum control rule are calculated by using a least square method.

[Step S152] A check is made as to whether or not a1·b2−a2·b1 is zero. If it is zero, the control plane is parallel, and the scoro set value and the LP set value cannot be calculated. Therefore, such coefficients of the control rule are not adopted, and the calculation of the control rule ends.

[Step S153] If a1·b2−a2·b1 is not zero, the coefficients can be adopted as the coefficients of the control rule, so that the write flag is set, and the processing of calculating the coefficients of the control rule ends.

[3] Embodiment 1

In a first embodiment, the ATC method is adopted as the toner supplying method in the above-described image forming apparatus. In this embodiment, a comparison is made between, on the one hand, the image density (the solid density or the highlight density; in this embodiment, the solid density is used) which is estimated when the TC is set to a predetermined prescribed value and, on the other hand, an image density corresponding to the actual value of the TC of the interior of the developing device 6 (FIG. 2), and control is provided such that the TC of the interior of the developing device 6 assumes the prescribed value by controlling the amount of toner supply in correspondence with an error thereof.

[3.1] Configuration of Toner Supply Control Section 50

FIG. 1 shows a toner supply control section 50 for controlling the amount of toner supply in the ATC method. In FIG. 1, the toner supply control section 50 is comprised of a standard operation variable value memory 51; a solid density calculator 52; a standard solid density retriever 54; and an image density comparator 55. In addition, the toner supply control section 50 is adapted to receive a measured output signal from a temperature/humidity sensor 53 provided in the image output section IOT (FIG. 2), and receive application control rules from a control rule retriever 30 of an image density control section 20.

The standard operation variable value memory 51 stores values of the standard operation variable values, i.e., the standard scoro set value and the standard LP set value in the case of this embodiment. The solid density calculator 52 retrieves a control rule for the solid density by using the control rule retriever 30 prepared for controlling the image density, and calculates the solid density in the case of the standard scoro set value and the standard LP set value. Since the control rule for the solid density corresponds to the TC value of the toner in the developing device 6, the solid density thus calculated also corresponds to the TC value of the toner in the developing device 6.

The standard solid density retriever 54 stores a lookup table (LUT) which shows values of the state variables as well as values of the solid image density corresponding to the values of aforementioned state variables under the conditions of target TC values and the standard operation variables. In this example, the temperature and humidity are used as the state variables. The contents of the LUT are shown in FIG. 23, for example. In the example shown in FIG. 23, the temperature is given in units of 5 degrees, and the humidity in units of 20%. In a case where finer units are used, interpolation is carried out to calculate a standard solid density. The standard solid density retriever 54 outputs a standard value of the solid density in response to an output signal from the temperature/humidity sensor 53 in the image output section IOT. The reason that the temperature and humidity are used as the state variables is because the toner charge amount has a high correlation with the humidity, and the potential of the electrostatic latent image on the photoreceptor has a high correlation with the temperature.

The image density comparator 55 compares the solid density corresponding to the TC value of the toner in the developing device 6 and the standard value of the solid density corresponding to a target TC value and retrieved by the standard solid density retriever 54. The result of comparison is supplied to a toner supplying device 56, and the toner supplying device 56 replenishes an appropriate amount of toner corresponding to the result of comparison to the developing device 6.

[3.2] Operation of Toner Supply Control Section 50

Figure 24:
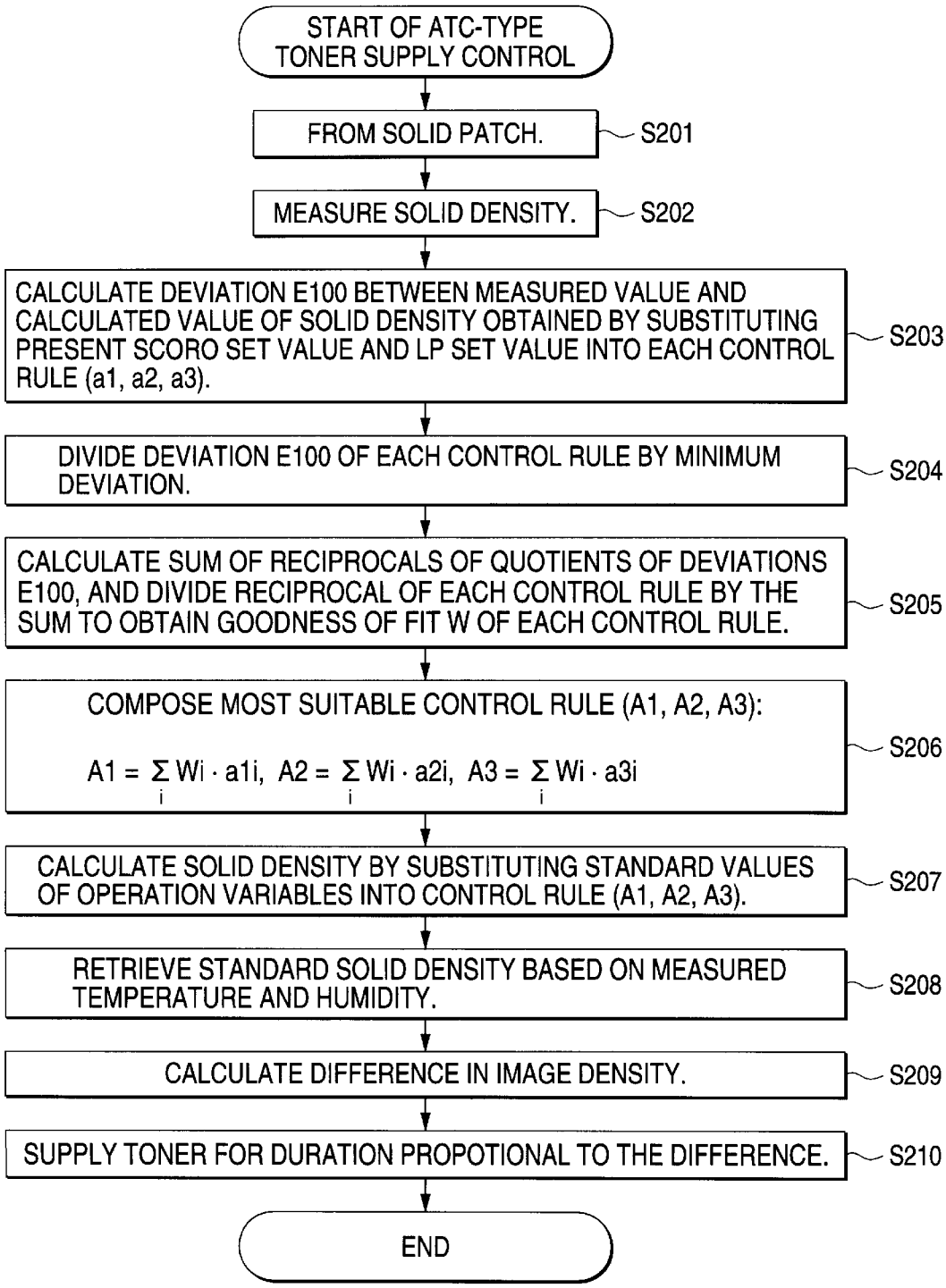
FIG. 24 is a flowchart explaining the operation in accordance with the first embodiment shown in FIG. 1.

Next, referring to FIGS. 24 and 25 as well, a description will be given of the operation of the toner supply control section 50. It should be noted that, in the following operation, it is assumed that the above-described initialization of image density control and the operation at the time of driving have already been effected, and that control rules concerning the solid density patch have been extracted.

In addition, such an LP set value and a scoro set value at which the potential of electrostatic latent images at the patches on the photoreceptor is set to a standard potential when the temperature and humidity (state variables) are at standard values, are stored in advance in the standard operation variable value memory 51 (here, it is assumed that the LP set value and the scoro set value are 138 and 145).

First, the solid density patch is prepared at the present LP set value and scoro set value (here, the values are assumed to be 98 and 76), and the solid density is measured by a development density sensor 10 (S201, S202). An example of this measurement is marked x in FIG. 25. Next, control rules which best fit the measured value are composed by using this measured value B6. That is, the deviation E100 between the actually measured value B6 and a calculated value of the solid density obtained by substituting the LP set value and the scoro set value (98, 76) into each control rule (a1, a2, a3) with respect to the solid density is determined (S203), and the deviation E100 of each control rule is divided by a minimum deviation E100 (S204). Then, a total sum of the reciprocals of the divided values with respect to the deviation E100 is determined, and the reciprocal of each control rule is divided by this total sum so as to be set as the goodness of fit W of each control rule (S205). This value is the same as the rate of contribution of the deviation E100 of each control rule in Step S142 in FIG. 21. The respective control rules (a1, a2, a3) are combined by using as the weight the goodness of fit thus determined, thereby composing control rules which best fit the measured value (S206). If the coefficients of the composed control rules are assumed to be A1, A2, A3, we have $$A1=\Sigma Wi\cdot ai,\ A2=\Sigma Wi\cdot bi,\ A3=\Sigma Wi\cdot ci.$$

Figure 25:
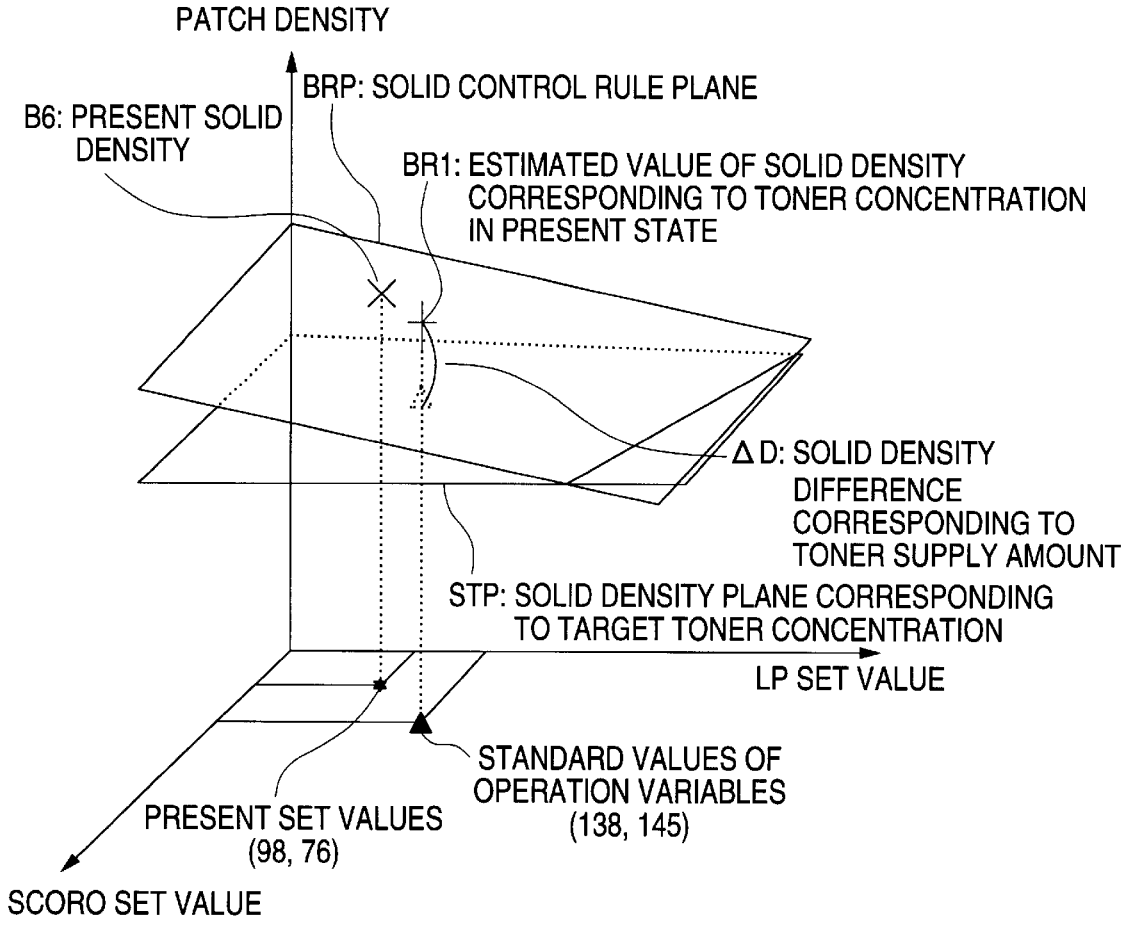
FIG. 25 is a diagram explaining the operation in accordance with the first embodiment shown in FIG. 1.

The composed rules are shown by BRP in FIG. 25. Then, the solid density corresponding to the values of the standard operation variables is calculated by substituting the values (138, 145) of the standard operation variables into the composed control rules (S207). The calculated solid density is marked + in FIG. 25.

On the other hand, in response to an output signal from the temperature/humidity sensor 53 in the image output section IOT, the standard solid density retriever 54 outputs a standard solid density persisting at a time when values of the standard operation variables are applied under the conditions of that temperature and humidity and under the condition of a prescribed TC value (S208). The plane of the standard solid density is shown by STP in FIG. 25. The image density comparator 55 compares this standard solid density and the solid density calculated from the control rules (S209), and the toner supplying device 56 supplies an appropriate amount of toner to the developing device 6 in correspondence with the result of this comparison ΔD (S210). Specifically, a dispense motor is driven for a time duration proportional to the solid density difference. A constant of proportion between the solid density difference ΔD and the motor driving time is determined by an experiment which is conducted beforehand.

In this configuration, a comparison is made between the solid density persisting at a time when the TC is at a prescribed value and the solid density corresponding to an actual TC value, and the amount of toner supply is controlled such that the result of this comparison becomes zero. Accordingly, the TC value can be controlled to the prescribed value.

[3.3] Advantages of Embodiment 1

(1) In this embodiment, control can be provided in such a manner as to maintain the TC at a constant level at all times by using the above-described control rules and without using the TC sensor. Consequently, since the sensor is made unnecessary, a reduction in cost can be attained. In addition, since the TC sensor is disused, factors hampering the flow of the developing agent in the developing device 6 are reduced, so that there are advantages in that burdens on the developing device and the developing agent can be reduced, and the degree of freedom in the design of the developing device 6 can be increased.

(2) Further, in this embodiment, since both image density control and toner supply control are effected, the image output section IOT is capable of forming stable final images at all times. At this time, since the TC is controlled in such a manner as to become constant, control is not provided in such a manner as to actively change the TC in the manner of the ADC method. That is, it suffices to replenish the toner only by the amount of toner consumed by the print of the image, so that the response characteristic becomes high as compared with the ADC method. However, since the TC is controlled in such a manner as to become constant at all times, the toner charge amount changes with changes in the environment. These changes can be corrected by image density control, and therefore do not constitute problems.

[3.4] Modification of Embodiment 1

(1) The optical development density sensor used in this embodiment is a mere example, and to obtain the advantages of the present invention a sensor of any type may be used insofar as it is capable of accurately measuring the densities of the development patches. In addition, an object to be monitored may be any type of image insofar as it has a high correlation with a final image density. For instance, it is possible to monitor any one of a developed image, a transferred image, and a fused image.

(2) In this embodiment, two kinds, a solid (halftone dot coverage of 100%) density patch and a highlight (halftone dot coverage of 20%) density patch, are adopted as the densities of the development patches. However, the development patches are not confined to these kinds, and only a density corresponding to a halftone dot coverage 50, for example, may be used, or a greater number of gradation points may be controlled by using more kinds of patches. Nevertheless, in a case where it is desirable to control the respective gradation points independently, it is necessary to prepare the kinds of controlling parameters in a number commensurate with the number of the gradation points.

(3) In this embodiment, the set value of development bias is made a fixed value; however, it is possible to make the set value of, for example, laser power fixed, and adopt the set value of the grid voltage of the scorotron charger and the development bias as control parameters. This is because development bias also has a high correlation with the solid density and a highlight density. Accordingly, as another combination, it is possible to fix the set value of the grid voltage of the scorotron charger and adopt the set value of laser power and the development bias as control parameters.

Alternatively, it is possible to control three gradation points, the set value of laser power, the set value of development bias, and the set value of the grid voltage of the scorotron charger. That is, control can be provided such that halftone dot overages are 100%, 50%, and 20%.

(4) The preparation of the development patches and sensing can be effected in utterly the same manner as the conventional manner, no restrictions are imposed in implementing this invention. As conventionally practiced, the patches may be prepared each time an image is formed, or the patches may be prepared only before or only after a series of jobs, or the patches may be prepared at each fixed time interval.

In general, the preparation of patches and their detection have an advantage in that the higher the frequency, the more accurately the state of reproduction of the image density can be ascertained, but have a disadvantage in that the toner is consumed by that portion. It suffices to adopt an optimum patch-preparing frequency in conformity with the specification and object of the image forming apparatus.

(5) In the control rule retriever, when control rules are composed by determining the goodness of fit of control rules, those control rules whose goodness of fit is smaller than a predetermined value (10%, 20%, or the like) may be ignored, and the goodness of fit may be determined again with respect to the remaining control rules, thereby providing control by configuring these steps. By providing such control, it is possible to prevent the effect of those control rules that have a weak bearing, so that it is possible to provide control with higher accuracy.

(6) In this embodiment, the time and the cumulative number of images are used as the state variables for controlling the image density, and the temperature and humidity are used as the state variables for controlling toner supply, but these state variables may be combined. For instance, when control rules concerning the density are retrieved, if the clusters are classified in advance for each 5 degrees of temperature, and from an output value of the temperature sensor being operated, control rules which fit among the clusters including that temperature is calculated, thereby making it possible to further enhance the accuracy with which the image density is controlled. Further, control accuracy may be enhanced by fetching the elapsed time as a state variable and using this and other state variables in combination with image density control and toner supply control.

(7) In this embodiment, inference rules are automatically extracted, but the inference rules may be prepared in advance by a technician through an experiment.

(8) In this embodiment, rules which best fit an actually measured value are composed, but one control rule may be selected, and only one control rule may be prepared. In this case as well, the control rule is preferably one which fits that state. Even if the control rule slightly deviates from its state, if the solid density corresponding to values of the standard operation variables is calculated by using an actually measured value of the solid density (e.g., $\Delta D$ is determined from $\Delta D = a1 \cdot \Delta LP + a2 \cdot \Delta SC$, and this value is added to an actually measured value D to determine a solid density D corresponding to the values of the standard operation variables), then the calculated solid density reflects the actual TC. Accordingly, if this density is compared with the standard solid density, and the amount of toner supply is controlled on the basis of the result of that comparison, it is possible to approximate the actual TC value to the target TC value.

[4] Embodiment 2

In a second embodiment, the ADC method is adopted as the toner supplying method in the above-described image forming apparatus. In this embodiment, a comparison is made between, on the one hand, the image density (the solid density or the highlight density; in this embodiment as well, the solid density is used) which is estimated when the toner charge amount is set to a prescribed value and, on the other hand, an image density corresponding to the actual toner charge amount in the developing device, and control is provided such that the toner charge amount in the developing device assumes the prescribed value by controlling the amount of toner supply in correspondence with an error thereof.

[4.1] Configuration of Toner Supply Control Section 60

Figure 26:
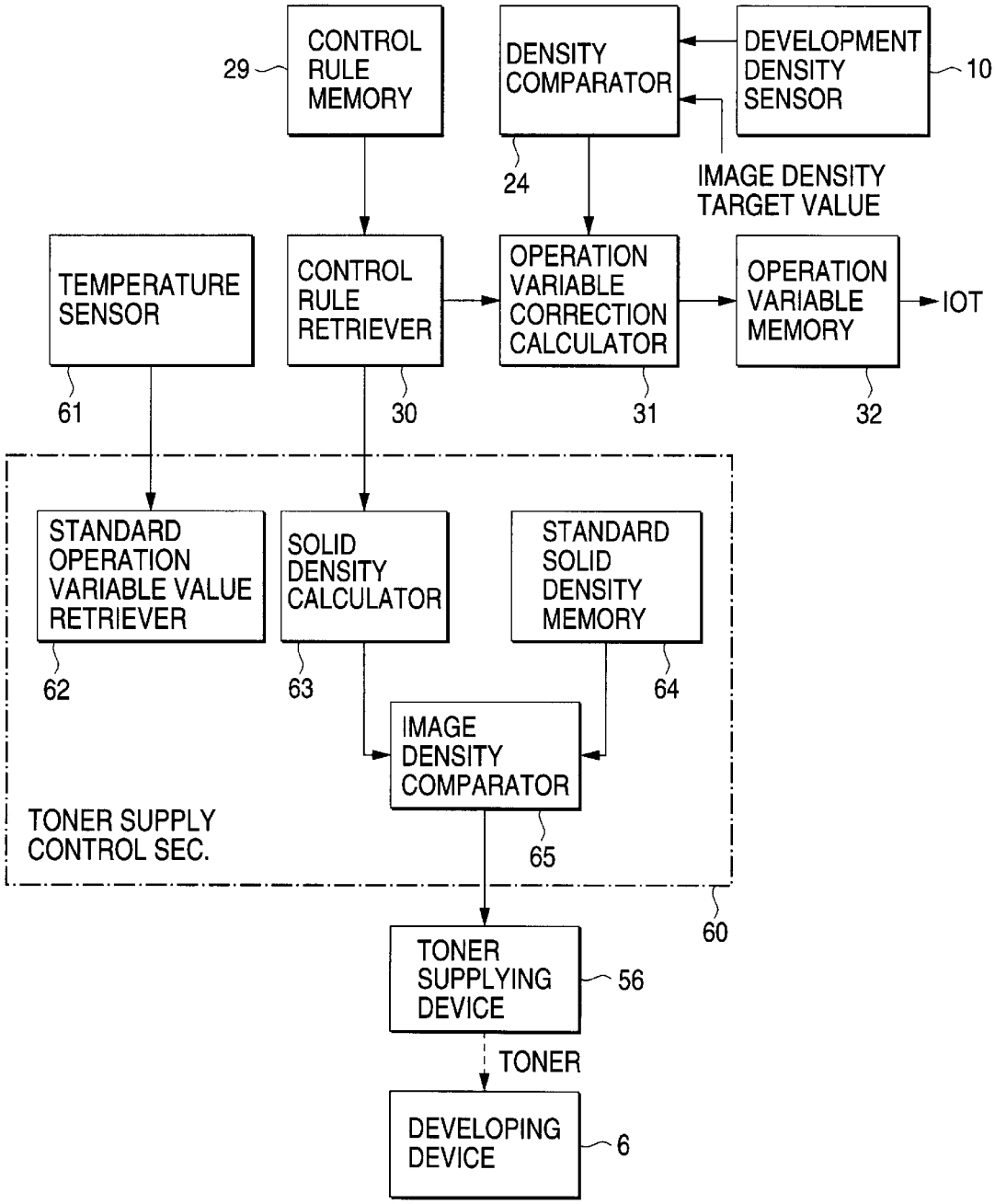
FIG. 26 is a block diagram explaining a configuration of a toner supply control section 60 in accordance with the second embodiment of the present invention.

FIG. 26 shows a toner supply control section 60 in accordance with this embodiment. In the drawing, the toner supply control section 60 is comprised of a standard operation variable retriever 62; a solid density calculator 63; a standard solid density memory 64; and an image density comparator 65. The standard operation variable retriever 62 stores a LUT which shows values of the state variable and pairs of a scoro set value and an LP set value for causing the potential at the portion of the photoreceptor 2 where the solid density patch PA1 is formed to be made a standard value under the condition of the state variable. An example of the contents of the LUT is shown in FIG. 27. In this example, the temperature of the interior of the image output section IOT is adopted as the state variable. The reason that the temperature is used as the state variable is because the potential of the electrostatic latent image on the photoreceptor 2 during the formation of the patch has a high correlation with the temperature. In this LUT as well, the temperature is given in units of 5 degrees, and in a case where finer units are used, interpolation is carried out to calculate an LP standard set value and a scoro standard set value. The standard operation variable retriever 62 receives an output signal from a temperature sensor 61 in the image output section IOT, and determines the scoro standard set value and the LP standard set value under the condition of the present state variable.

The solid density calculator 63 infers a solid density corresponding to the present toner charge amount in the developing device 6 in a case where the operation variables are set to the scoro standard set value and the LP standard set value which are outputted from the standard operation variable retriever 62. Incidentally, a description will be given later of the method of inference.

The standard solid density memory 64 stores the standard value of the solid density, i.e., the density of images formed with the toner of a prescribed value of the charge amount when the potential of the electrostatic latent image on the photoreceptor 2 during the formation of patches is the standard potential. The image density comparator 65 compares the standard value of the solid density stored in the standard solid density memory 64 and the density of the image formed at a portion of the standard potential in the present state o the toner in the developing device 6. The result of this comparison is sent to the toner supplying device 56, which, in turn, supplies an appropriate amount of toner to the interior of the developing device 6 in correspondence with the result of comparison.

[4.2] Operation of Toner Supplying Section

Figure 28:
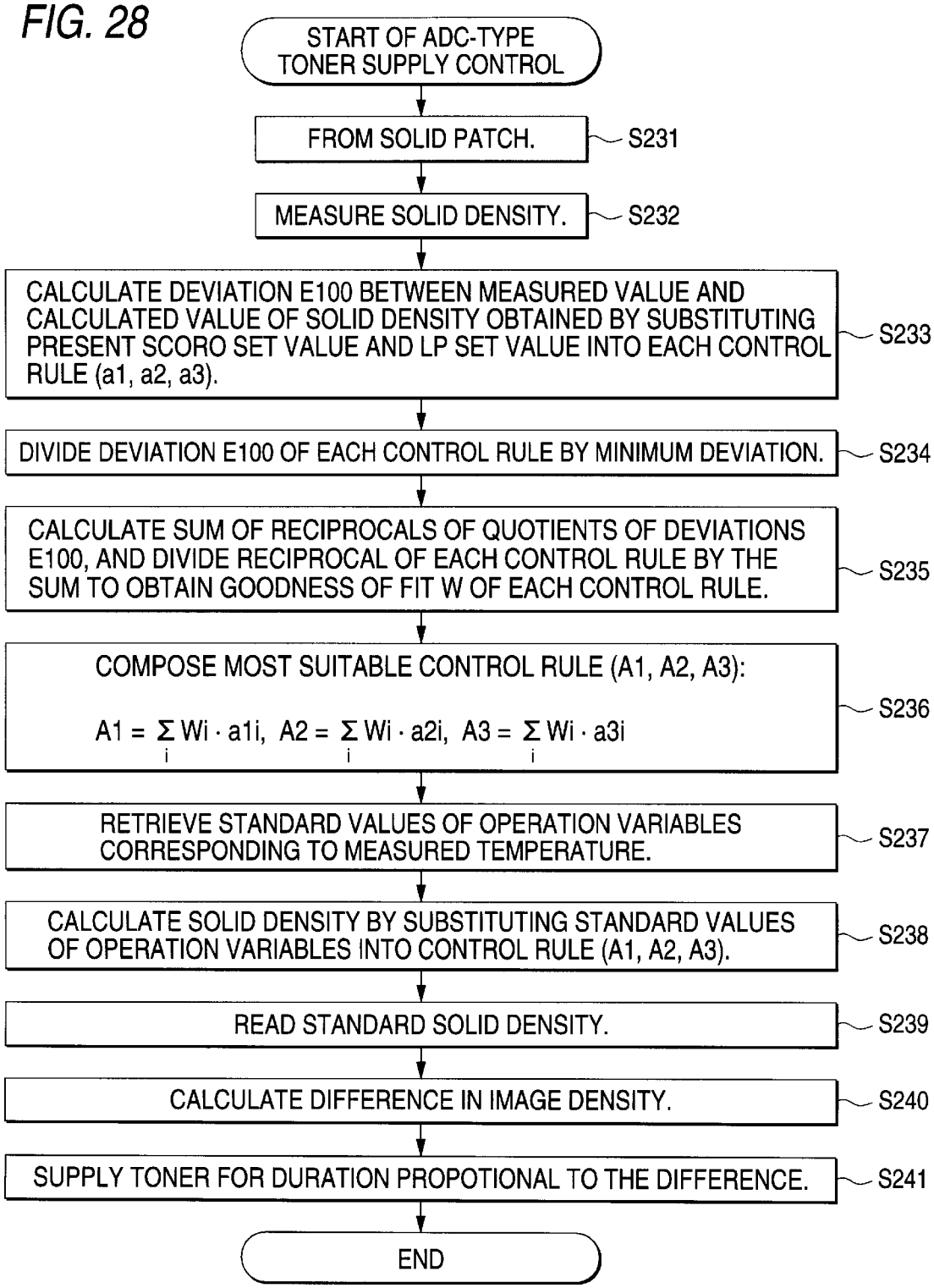
FIG. 28 is a flowchart explaining the operation in accordance with the second embodiment shown in FIG. 26.

Next, referring to FIGS. 28 and 29 as well, a description will be given of the operation of the toner supply control section 60. It should be noted that, in the following operation, it is assumed that the above-described initialization of image density control and the operation at the time of driving have already been effected, and that control rules concerning the solid density patch have been extracted.

First, in the image output section IOT, the solid density patch is prepared at the present LP set value and scoro set value (here, the values are assumed to be 98 and 76), and the solid density is measured by a development density sensor 10 (S231, S232). An example of this measurement is marked x in FIG. 29. Next, control rules which best fit the measured value are composed by using this measured value B7. That is, the deviation E100 between the actually measured value B7 and a calculated value of the solid density obtained by substituting the LP set value and the scoro set value (98, 76) into each control rule (a1, a2, a3) is determined (S233), and the deviation E100 of each control rule is divided by a minimum deviation E100 (S234). Then, a total sum of the reciprocals of the divided values with respect to the deviation E100 is determined, and the reciprocal of each control rule is divided by this total sum so as to be set as the goodness of fit W of each control rule (S235). This value is the same as the rate of contribution of the deviation E100 of each control rule in Step S142 in FIG. 21. The respective control rules (a1, a2, a3) are combined by using as the weight the goodness of fit thus determined, thereby composing control rules which best fit the measured value (S236). If the coefficients of the composed control rules are assumed to be A1, A2, A3, we have $$A1=\Sigma Wi\cdot ai,\ A2=\Sigma Wi\cdot bi,\ A3=\Sigma Wi\cdot ci.$$

Figure 29:
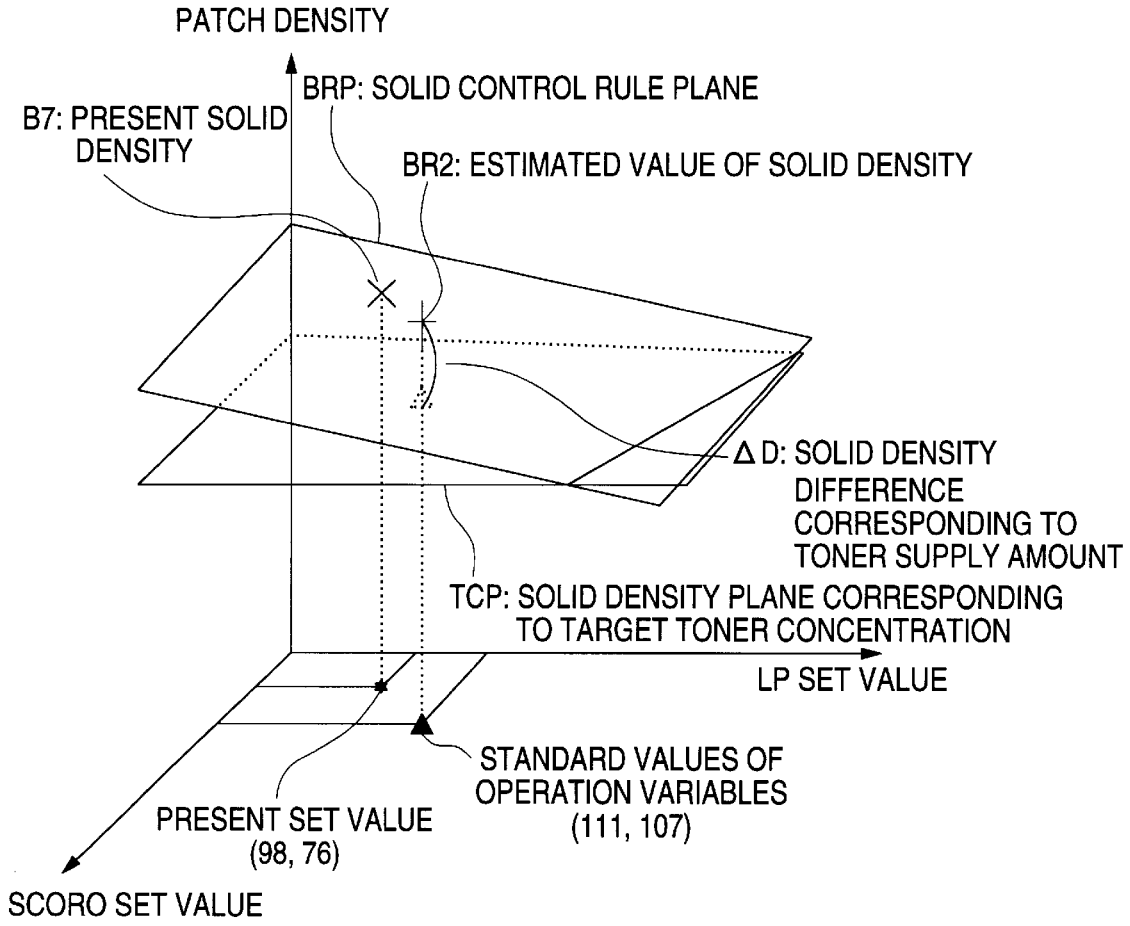
FIG. 29 is a diagram explaining the operation in accordance with the second embodiment shown in FIG. 26.

The composed rules are shown by BRP in FIG. 29. Then, the solid density corresponding to the standard toner charge amount and the values of the standard operation variables is calculated by substituting the LP standard set value and the scoro standard set value from the standard operation variable retriever 62 into the composed control rules (S237, S238). The solid density is marked + and indicated by BR2 in FIG. 25.

On the other hand, the density of the image formed under the conditions of the standard toner charge amount and the standard potential, i.e., the standard value of the solid density, is read from the standard solid density memory 64 (S239), and the standard value of the solid density and the solid density calculated by the solid density calculator 63 are compared by the solid density comparator 65 (S240). The standard value of the solid density is indicated by TCP and a triangular mark in FIG. 29. Then, the toner supplying device 56 supplies an appropriate amount of toner to the developing device 6 in correspondence with the result of this comparison (S241). Specifically, the dispense motor is driven for a time duration proportional to the solid density difference. A constant of proportion between the solid density difference and the motor driving time is determined by an experiment which is conducted beforehand.

In this configuration, a comparison is made between the solid density persisting at a time when the toner charge amount is a standard value and the solid density corresponding to an actual value of the toner charge amount, and the amount of toner supply is controlled such that the result of this comparison becomes zero. Accordingly, the toner charge amount can be controlled to the standard value.

Although, in this embodiment, the temperature is used as the state variable, it is possible to use the humidity or the cumulative number of images other than the temperature. Further, these state variables may be used in combination.

[4.3] Advantages of Embodiment 2

(1) In this embodiment, by using control rules used for image density control, the toner charge amount can be maintained at a fixed level without requiring a potential sensor (a potential sensor for measuring the standard potential). Consequently, since the sensor is made unnecessary, a reduction in cost can be attained.

(2) In this embodiment, since the image controlling patch is used jointly for controlling the toner supply as well, it is unnecessary to prepare a special reference patch only for controlling the toner supply. Since the number of times the patches are formed is not increased, it is possible to eliminate processes which are not directly related to the preparation of output images, which leads to increased printing speed. In addition, since the number of times development patches are formed is not increased, it is possible to suppress an increased load on the cleaner and a decline in the life, and it is possible to reduce the amount of toner to be disposed of, thereby contributing to the maintenance of the environment.

(3) In this embodiment, since both the image density control and the toner supply control (ADC) are carried out, stable final images are obtained by the image output section at all times. At that time, since the toner supply is controlled such that the toner charge amount becomes constant, the operation is effected in such a manner as to further stabilize the image density. That is, in a case where the temperature and the humidity changed slowly, the toner charge amount is controlled to a fixed level, fluctuations of the development patch density with respect to environmental changes become only the fluctuations of the potential of the electrostatic latent image on the photoreceptor. Accordingly, the set values of the operation variables stay in the vicinities of the standard values, so that there is an advantage in that it is possible to reduce the occurrence of secondary trouble including a stress on various portions of the IOT due to an extreme setting of the operation variable, the deterioration of image quality such as fogging, and so on.

It should be noted that in a case where the environment such as the temperature and humidity has suddenly changed, there is a possibility that the response of the toner supply control is unable to follow the sudden change, causing the toner charge amount to fluctuate temporarily. For this reason, in the toner supply control of the conventional ADC method, the potential of the electrostatic latent image is controlled in such a manner as to be maintained at a fixed level, with the result that there has been a drawback in that the density of an output image changes substantially in a transient state until the toner charge amount reaches a target value. In this embodiment, even in such a case it is possible to cope with such a situation by the image density control, and the image output section IOT outputs stable final images at all times. It effect is large particularly when the toner charge amount is excessively small.

[4.4] Modification of Embodiment 2

(1) In this embodiment as well, a modification similar to that of the first embodiment is possible with respect to the control of image density and extraction of inference rules. In addition, as for the state variables as well, control accuracy can be improved by combining the time, temperature, and humidity.

(2) In this embodiment, the LUT is used in the standard operation variable retriever 62 of the toner supply control section 60, but any means may be used insofar as it is capable of outputting set values of the standard operation variables under the condition of the present state variable. For example, set values of the standard operation variables at two points of 10° C. and 25° C. may be determined in advance, and set values at other temperatures may be determined by proportional distribution.

(3) Both the ACT method of the first embodiment and the ADC method of the second embodiment may be incorporated into the same image forming apparatus, and the two control methods may be used by being changed over depending on the purpose of use or the condition of use of the apparatus. For example, in an apparatus which outputs several hundred images a day, an arrangement is provided such that the toner charge amount is controlled to a fixed level so as to reduce variations with respect to environmental changes and make the widths of fluctuation of the operation variables small, and the number of cases and the number of clusters are reduced to decrease the amount of memory used. On the other hand, in an apparatus which prints only several images a day, an arrangement is provided is such that the ATC method is used so as to maintain the TC at a fixed level at all times. In the ADC method, in order to change the TC by a large degree it is necessary to output a commensurate number of images, so that in a case where the number of images outputted is small, the ADC method is not suitable.

As described above, in accordance with the present invention, an arrangement is provided such that a characteristic value such as the image density under a predetermined condition is calculated on the basis of rules used for controlling the characteristic value such as the image density; the characteristic value such as the image density, which is estimated under the aforementioned predetermined condition and under the condition that a predetermined characteristic concerning the toner (e.g., the TC or the toner charge amount) is maintained at a predetermined target value; the characteristic values of these two image densities or the like are compared; and the toner supply to the developing device is controlled on the basis of the result of comparison such that the predetermined characteristic concerning the toner is maintained at the target value. Accordingly, an error concerning the characteristic of the toner, such as the TC or the toner charge amount, is indirectly measured through the result of comparison of the characteristic values of the aforementioned two image densities or the like. Hence, it is unnecessary to directly measure the TC or the toner charge amount, so that a sensor can be eliminated. Moreover, since the patches for measuring the image density, the control rules, and the controlling mechanism can be used jointly, it is possible to reduce the cost necessary for toner control. In addition, it is possible to maintain final images in a state of high quality through control of the image density and the toner supply.

What is claimed is:

1. An electrophotographic image forming apparatus for forming an image by developing an electrostatic latent image with a toner while controlling a predetermined characteristic of the toner to a target value, said image forming apparatus comprising:

toner supplying means for supplying the toner to a developing device;

means for forming a reference image;

means for measuring a physical quantity of the formed reference image;

storage means for storing a rule prescribing a relationship between the physical quantity of the reference image and a predetermined operation variable of a main body of said image forming apparatus;

means for controlling the physical quantity of the reference image by correcting the operation variable by using the rule;

calculating means for calculating, according to the rule, a first value of the physical quantity of the reference image to be obtained under a predetermined condition;

output means for outputting a second value of the physical quantity of the reference image which is expected under the predetermined condition and a condition that the predetermined characteristic of the toner is set at the target value;

means for generating a difference between the first and second values of the physical quantity of the reference image; and means for adjusting an amount of the toner to be supplied to said toner supplying means in accordance with the generated difference.

2. The image forming apparatus according to claim 1, wherein the characteristic of the toner is a toner/carrier mixing ratio.

3. The image forming apparatus according to claim 1, wherein the characteristic of the toner is a toner charge amount.

4. The image forming apparatus according to claim 1, wherein said calculating means calculates the first value of the physical quantity of the reference image by using, as a reference, a value of the physical quantity measured by said measuring means.

5. An electrophotographic image forming apparatus for forming an image by developing an electrostatic latent image with a toner while controlling a toner/carrier mixing ratio to a target value, said image forming apparatus comprising:

toner supplying means for supplying the toner to a developing device;

means for forming a reference image;

means for measuring an optical density of the formed reference image;

storage means for storing a rule prescribing a relationship between the optical density of the reference image and a predetermined operation variable of a main body of said image forming apparatus;

means for controlling the optical density of the reference image by correcting the operation variable by using the rule;

calculating means for calculating, according to the rule, a first value of the optical density of the reference image to be obtained when the operation variable is set at a predetermined standard value;

output means for outputting a second value of the optical density of the reference image which is expected under conditions that the operation variable is set at the predetermined standard value and the toner/carrier mixing ratio is set at the target value;

means for generating a difference between the first and second values of the optical density of the reference image; and means for adjusting an amount of the toner to be supplied to said toner supplying means in accordance with the generated difference.

6. The image forming apparatus according to claim 5, further comprising environmental-variable measuring means for measuring an environmental variable of said main body of said image forming apparatus, wherein said output means estimates and outputs the second value of the optical density of the reference image in accordance with a measured value of said environmental-variable measuring means.

7. An electrophotographic image forming apparatus for forming an image by developing an electrostatic latent image with a toner while controlling a toner charge amount at a target value, said image forming apparatus comprising:

toner supplying means for supplying the toner to a developing device;

means for forming a reference image;

means for measuring an optical density of the formed reference image;

storage means for storing a rule prescribing a relationship between the optical density of the reference image and a predetermined operation variable of a main body of said image forming apparatus;

means for controlling the optical density of the reference image by correcting the operation variable by using the rule;

calculating means for calculating, according to the rule, a first value of the optical density of the reference image to be obtained when the operation variable is set at a value for making a potential of a latent image of the reference image a predetermined standard potential;

output means for outputting a second value of the optical density of the reference image which is expected when the potential of the latent image of the reference image is set at the standard potential and the toner charge amount is set at the target value;

means for generating a difference between the first and second values of the optical density of the reference image; and means for adjusting the toner charge to be supplied to said toner supplying means in accordance with the generated difference.

8. The image forming apparatus according to claim 7, further comprising environmental-variable measuring means for measuring an environmental variable of said main body of said image forming apparatus, wherein said output means estimates and outputs the second value of the optical density of the reference image in accordance with a measured value of said environmental-variable measuring means.

9. The image forming apparatus according to claim 1, further comprising rule forming means for forming the rule based on data of the physical quantity and the operation variable which are obtained when the reference image is formed a plurality of times.

10. The image forming apparatus according to claim 5, further comprising rule forming means for forming the rule based on data of the physical quantity and the operation variable which are obtained when the reference image is formed a plurality of times.

11. The image forming apparatus according to claim 7, further comprising rule forming means for forming the rule based on data of the physical quantity and the operation variable which are obtained when the reference image is formed a plurality of times.

12. The image forming apparatus according to claim 9, wherein said rule storage means stores the rule for each of different states.

13. The image forming apparatus according to claim 12, further comprising rule composing means for composing a rule suitable for values of the optical density and the operation variable obtained when a current reference image is formed from the rules stored in said rule storage means, wherein said calculating means calculates the first value of the optical density by using the composed rule.

14. The image forming apparatus according to claim 12, wherein whether the states are different from each other is determined based on at least one of a temperature, a humidity, and a cumulative number of formed images.

15. An electrophotographic image forming method for forming an image by developing an electrostatic latent image with a toner while controlling a predetermined characteristic of the toner to a target value, comprising the steps of:

supplying the toner to a developing device;

forming a reference image;

measuring a physical quantity of the formed reference image;

storing a rule prescribing a relationship between the physical quantity of the reference image and a predetermined operation variable of a main body of an image forming apparatus;

controlling the physical quantity of the reference image by correcting the operation variable by using the rule;

calculating, according to the rule, a first value of the physical quantity of the reference image to be obtained under a predetermined condition;

outputting a second value of the physical quantity of the reference image which is expected under the predetermined condition and a condition that the predetermined characteristic of the toner is set at the target value;

generating a difference between the first and second values of the physical quantity; and adjusting an amount of the toner to be supplied to said toner supplying means in accordance with the difference.

* * * * *